US008939059B2

(12) United States Patent
Coffman, II

(10) Patent No.: US 8,939,059 B2
(45) Date of Patent: Jan. 27, 2015

(54) PROGRESSIVE GUN SPRING RECOIL SYSTEM WITH HIGH ENERGY REBOUND

(71) Applicant: Charles W. Coffman, II, Austin, TX (US)

(72) Inventor: Charles W. Coffman, II, Austin, TX (US)

(73) Assignee: Recoil Rebound, LLC, Austin, TX (US)

( * ) Notice: Subject to any disclaimer, the term of this patent is extended or adjusted under 35 U.S.C. 154(b) by 0 days.

(21) Appl. No.: 14/053,936

(22) Filed: Oct. 15, 2013

(65) Prior Publication Data

US 2014/0216243 A1 Aug. 7, 2014

Related U.S. Application Data

(60) Provisional application No. 61/714,475, filed on Oct. 16, 2012.

(51) Int. Cl.
*F41A 3/80* (2006.01)
*F41A 3/10* (2006.01)
*F41A 3/82* (2006.01)

(52) U.S. Cl.
CPC ... *F41A 3/10* (2013.01); *F41A 3/80* (2013.01); *F41A 3/82* (2013.01)
USPC ..... 89/44.01; 89/177

(58) Field of Classification Search
CPC ..... F41A 3/80; F41A 3/82; F41A 3/84; F41A 3/86
USPC ..... 89/44.01, 44.02, 177, 178
See application file for complete search history.

(56) References Cited

U.S. PATENT DOCUMENTS

| | | | | |
|---|---|---|---|---|
| 2,701,963 | A * | 2/1955 | Balleisen | 73/167 |
| 3,517,586 | A * | 6/1970 | Stoner | 89/198 |
| 4,754,689 | A | 7/1988 | Grehl | |
| 4,974,493 | A | 12/1990 | Yeffman | |
| 5,069,110 | A | 12/1991 | Menck | |
| 6,349,495 | B1 * | 2/2002 | Fluhr | 42/70.08 |
| 7,493,845 | B2 | 2/2009 | Mantas | |

OTHER PUBLICATIONS

Roberts, Greg; "Recoil Control for Pistols from DPM Systems"; Combat & Survival; Feb. 2012; pp. 28-32; vol. 23, Issue 11; Huddersfield, United Kingdom.

* cited by examiner

*Primary Examiner* — Stephen M Johnson

(57) ABSTRACT

A spring/rod recoil assembly may be improved with Belleville springs arranged in combinations of nested and inverted stacks that absorb recoil impact energy while providing rebound energy to properly load cartridges from the magazine into the chamber. A firearm assembly may include a cylindrical spring, and guide rod—having stops at both ends—lengthwise situated within the cylindrical spring. The assembly may include a Belleville spring stack captured on the guide rod between a back-end stop and the cylindrical spring, with one or more stacks of nested springs and one or more stacks of inverted springs. The spring stack may be arranged to return some of the recoil energy produced during firing of the firearm, and decelerate slide velocities without damage to the firearm. Each spring has a diameter allowing it to fit within a back chamber where at least the back-end of the guide rod and spring are situated.

29 Claims, 19 Drawing Sheets

PROGRESSIVE GUN SPRING RECOIL SYSTEM WITH HIGH ENERGY REBOUND

PRIORITY CLAIM

This application claims benefit of priority of U.S. provisional application Ser. No. 61/714,475 titled "Progressive Gun Spring Recoil System with High Energy Rebound", filed Oct. 16, 2012, which is hereby incorporated by reference in its entirety as though fully and completely set forth herein.

BACKGROUND OF THE INVENTION

1. Field of the Invention

This invention relates generally to semiautomatic gun mainspring recoil systems, and more specifically to a recoil spring system with improved lock-up, rebound, and reduced muzzle rise with minimal impact.

2. Description of the Related Art

FIG. 2 is shows a typical semiautomatic gun recoil spring that traditionally uses a guide rod 204 and mainspring 202 with enough force suitable to offset the force of the blowback of the slide, and allow proper cycling of action. If the spring 204 is too light, the slide velocity can reach high enough values to result in an impact on the frame that can cause premature wear, damage or failure to the firearm, and injury to the firearm operator. If the spring 204 is too heavy, the gun may not cycle properly and be prone to misfeeds or gun jamming. Typically, semiautomatic handguns use between ten (10) to twenty (20) pound springs. While up to 28-pound springs have been used to address the heavier recoil associated with higher power factor loads, they are seldom used, as they are extremely difficult to operate. The high spring pressure makes it too difficult to manually operate the slide and/or slide-stop/release. Additionally, these heavy springs do not facilitate proper functioning of light loads, and many firearm operators either lack the physical strength, or prefer not to exert the physical energy required to operate a firearm utilizing a higher than a 17-pound mainspring. These heavy springs create a number of challenges, especially when shooting light or low power loads, and heavy or higher power loads in a gun. Reliable feeding of 9 mm semiautomatic handguns is particularly difficult if the desire is to ensure a range of standard 9 mm light target loads through 9 mm +P heavy loads. These loads typically represent around 300 foot-pounds (ft-lbs) of energy for SAAMI (Sporting Arms and Ammunition Manufacturers' Institute) standard loads, and 400 ft-lbs of energy for 9 mm +P loads. Efforts to produce lighter, smaller, and more powerful semiautomatic handguns have been limited by the physics of recoil. To deal with more recoil, more weight or stronger spring force is required. The use of heavier springs becomes unmanageable at some point, as it increases the difficulty in releasing the slide stop/release from a locked back position to open the slide.

Advances in metallurgy, powders (propellants), and improved acceleration methods have introduced additional problems. For example, cartridges can now produce more ft-lbs of energy than what the frame of a gun may be able to withstand. This is especially true for designs that attempt to concentrate more energy into smaller, more compact, concealable semiautomatic handguns. The problem is even more pronounced with the rise in popularity of lighter, less expensive polymer frames, which are not as strong as their metal counterparts, and lack the weight to absorb the energy-transfer from the recoil. More and more higher-pressure variants of modern cartridges are being introduced. The 45 ACP (Automatic Colt Pistol) for example, has evolved from 45 ACP (21,000 PSI), 45ACP+P (23,000 PSI), 45 Super (28,000 PSI), 0.460 Rowland (40,000 PSI), and 45 Coffman (50,000 PSI). While the pressure may have doubled, the ft-lbs may have tripled, as in the case of standard 9 mm, typically 300 ft-lbs, and the 9 mm Coffman at 967 ft-lbs. The operation of firearms with lower recoil, the use of less expensive ammunition in a "Magnum" variant of a semiautomatic firearm, as well as the rise in popularity of suppressors that reduce the blowback force necessary to operate the firearm necessitate the installation of lighter springs, which leads to the need for an improved method capable of addressing such a wide range of slide velocities while providing proper lock-up.

Current improvements have centered on incorporating a full-length spring inside another spring, or employing a dual-spring system. An example is provided in FIG. 3, where a spring assembly 300 includes a full-length spring 304 incorporated inside another spring 302 to help progressively dampen the recoil throughout the full length of the guide rod/enclosure 306. Another example of a dual spring assembly 402 is shown in FIG. 4. More specifically, FIG. 4 illustrates a captured dual spring assembly that includes a captured light and heavy progressive stack Glock Gen4. Even in progressive spring systems the spring force increases substantially prior to the last (approximately) ¼" of travel, thus increasing the force required to depress and release the slide stop, which is the primary reason that over 20-pound springs are seldom used. This is illustrated in FIG. 12, which shows a semiautomatic handgun to illustrate the over-travel with respect to the slide-stop. As indicated in FIG. 12, in a closed state 1200 of the handgun, the breech is closed (indicated by 1210 and 1212), whereas in an open state 1202 of the handgun the slide is locked in place by the slide stop (indicated by 1214). In an over-travel state 1204, the travel is beyond the slide stop, which is further illustrated in magnified area 1220, which shows the slide stop lever on the frame at the left arrow of 1222, with the slide stop notch in slide shown at the right arrow of 1222. The slide stop lever 1224 has a tab that is pushed upward by the magazine follower when the last round is fired, basically catching or stopping the slide from advancing forward, hence the name slide stop, which indicates to the firearm operator that the firearm is empty. In the locked back position, once the operator has inserted a new magazine, the slide stop lever may be depressed, releasing the slide to move forward. This too is very difficult to perform one handed (which is nonetheless the preferred method of operation) if the main spring force is above 17 pounds.

In the case above, all of the recoil above the 20+ pounds of force is directed into the frame of the firearm and into the operator's body. This excessive impact causes the slide to dwell in the recoiling motion until both the frame and operator absorb the recoil until such a time as the main spring(s) recover and redirect the slide forward. FIG. 5 provides an example of another method that involves the use of buffers 502 to absorb the excess force of impact. Buffer 502 may be situated within a spring assembly as shown within a handgun 552. FIG. 6 provides an illustration of another type of buffer 604 that may be used on a guide rod 602 in a guide rod assembly 610. The guide rod 602 may be used with mainspring 606 and buffer 604 in a gun 608 as also shown in FIG. 6. FIG. 7 shows yet another example of a buffer 706 placed on a guide rod 708 in the rod assembly 702, and shown with a spring in assembly 752. While the buffer method is somewhat effective in buffering the forces that might damage the frame from metal-on-metal contact, they barely, if at all, absorb or decelerate the main force of impact, again relying on the frame and the operator to absorb these forces and allow the mainspring to recover. Such buffers are typically made of urethane or elastomer materials, which are prone to premature wear usually limited to 100-1200 rounds of ammunition. In tests conducted with a high-pressure variant of the 0.380 ACP (200 ft-lbs), and the 380 Coffman (420 ft-lbs) in a Sig Sauer P238, the buffer lasted less than ten shots due to lacerations from the slide stop. Additionally, while elastomer buffers do provide some energy absorption, the rebound force is virtually non-existent.

Most semi automatic firearms will facilitate the use of lighter springs to ease the manual operation by user and increase slide velocity for improved cycling. While some multi-spring combinations reduce the spring weight needed, the gun design and size may necessitate a higher spring weight than is comfortable or physically possible for some people to operate. This is especially true of the industries movement to the internal striker design and more compact polymer frame pistols. The micro compact polymer frame firearms lack the weight to adequately deal with the recoil necessitating an even heavier spring. The internal striker design consistent with Glock pistols necessitates heavier springs, since in such a design the striker/firing pin spring and the main spring inherently oppose one another. While a conventional semiautomatic firearm may only need a 11-pound to 15-pound spring to remain securely in battery instance, the internal striker design would dictate an 17-18-pound mainspring, so when the 5.5-pound firing pin spring is under load and opposing the 18-pound mainspring, a net effect of 13.5 pounds of force remains to keep the gun securely in battery.

There exists therefore a need for improved ease of operation of firearms while maintaining proper lock-up, increased slide velocity and rebound energy with reduced impact and muzzle rise in semiautomatic weapon recoil systems.

SUMMARY

A progressive recoil action system may be designed and used in semiautomatic handguns to allow for the use of lighter springs suitable for basic operation of light loads, and higher energy density springs that provide a "rebound" effect to absorb any additional force. In one set of embodiments, the basic components of a novel spring assembly used in a novel recoil action system may include a guide rod, a mainspring, and a stack of Belleville springs. A high-energy stack of Belleville disc springs may be used to modify the spring recoil assembly for the recoil action system. The Belleville springs may be combined in three basic stacking configurations, including a nested stack, inverted stack, and nested-and-inverted (or mixed) stack. The conical springs may hold large loads in small spaces, and have been used to maintain tension at the ends of valves and bearings. Compared to Belleville washers, Belleville springs can repeatedly return to their original height once working loads are removed.

Belleville springs are designed to fit over rods (according to a minimum inner diameter) and into holes (according to a maximum outer diameter), providing an ideal addition to spring guide rod and sleeve assemblies used in firearm recoil systems. They may be used singly, or stacked to increase load (i.e. the amount of force applied to the spring) and deflection (i.e. the distance the spring(s) compresses). Increasing the number of springs in a nested stack allows for increased loads that may be applied to the spring stack. Increasing the number of springs in an inverted stack allows for increased deflection while retaining the same load or force (e.g. load or force of only one spring) across the span of the stack. In a nested-and-inverted (mixed) stack both load and deflection may be adjusted, i.e. increased or decreased as desired, based on the combination of Belleville springs used. "Deflection at working load" refers to the distance the spring compresses when the given load is applied. "Flat Load" refers to the load at which the spring is completely compressed.

Typically, Belleville springs can support weight ranging from forty pounds to one hundred fifty pounds each, based on the thickness, diameter and height. Because of their extremely compact nature, Belleville springs may be placed behind the slide stop in a semiautomatic handgun recoil assembly, making the basic operation of the gun very easy and simple. In fact, with this combination, the mainspring weight may be reduced for even greater ease of operation. The travel behind the slide stop may be addressed with a very heavy spring stack optimized for maximum slide velocity for positive feeding of the full range of ammunition. During testing, the rebound generated by the Belleville stack in heavier loads resulted in the slide velocity exceeding the gun's capability to feed a bullet from the magazine.

By more efficiently dealing with excessive recoil, it is possible to maximize the slide velocity. The faster the slide can cycle, the flatter the firearm will shoot, leaving less time for muzzle climb that is typically experienced with heavier springs slowing down the slide velocity across the entire distance of slide travel. The increase in slide velocity also improves proper bullet feeding and ejection. It is not uncommon for a "stove top" condition to occur, especially in 9 mm and 45ACP. "Stove top condition" refers to when there is not enough blowback force to oppose the spring pressure, preventing the slide from complete travel, resulting in a partial ejection with the cartridge getting lodged between the slide and barrel. This may happen when a person is operating the firearm with a limp wrist or otherwise fails to maintain a firm grip on the gun frame. The faster slide velocity of the rebound system ensures fewer jams, making it less critical for the operator to have a proper firm grip on the firearm. It also improves life safety if, for example, an officer is wounded and is not able to properly hold the firearm, or is wounded in a way that forces the officer to shoot offhand with their other hand. It further helps improve the likelihood of proper cycling of the firearm with an officer involved in a struggle with a perpetrator.

The higher slide velocity combined with the ability to return up to 75% of that velocity also improves bullets feeding into the chamber. 9 mm and 45ACP models are notorious for not feeding properly. With light loads, they do not always force the slide to complete travel, and the spring force applied is sometimes not enough to provide a positive feed and lock-up of slide and barrel. One advantage of a novel rebound spring system with Belleville springs is that it facilitates a substantially greater range of calibers and recoil that may be managed by the system, without requiring spring changes. This is especially true of AR-15 style firearms in which the spring system is a closed system stock of the lower unit. It is common for firearm operators to exchange the "upper" section of their firearm to different configurations, or calibers, which have a wide range of recoil levels. Various embodiments of a novel recoil rebound system may facilitate maximizing the cycle or fire rate of a given firearm. Thus, the recoil exceeding the control capability of the mainspring no longer results in the slide slamming into the frame, slamming into the rebound spring stack instead, leading to a substantial reduction in recoil, especially with heavy loads. Even progressive spring systems stop at about 26 pounds of force, with forces beyond that level resulting in frame on frame impact. While polymer frames are generally more forgiving of this type of impact, the point of contact is subject to increased wear and tear. Metal on metal contact may lead to metal fatigue further away from the impact point, resulting in a slide breaking in half and injuring the firearm operator. Because the rebound spring stack more efficiently absorbs the recoil, the wear and tear on the firearm and on its operator's hands, joints and cartilage are greatly reduced.

When the firearm is fired, the blowback of the slide may be delayed by collets (which may be captured by the main spring) as they expand outwardly from the guide rod to travel over the lock-up ridge in the front of the guide rod. The ridge on the guide rod may be optimized to have a steeper angle to overcome during the initial blow back, with a more gradual ramp making returning to lock-up easier. The angles and radius of the ridge combined with the mechanical means of retaining the collets (or collet segments) allow for optimal tuning of the additional holding or lock-up force that can be maintained. While a coil spring may be adequate to hold the collets in place, the force of the main spring may also determine lock-up pressure. The heavier the mainspring, the more force may be applied for lock-up.

Various embodiments of a "recoil rebound" system disclosed herein provide the ability to return up to 75% of the recoil energy received, and efficiently decelerate tremendous slide velocities without damage to the firearms. The move of semi-automatic handguns to the internal striker design has necessitated the use of a much heavier mainspring. The resulting use of 17-pound and 18-pound springs is considered by most to be too heavy, making the manual operation of the firearm challenging to most, and bordering on impossible for many individuals who are not physically strong enough. Thus, various rebound systems introduced herein facilitate the use of lighter, more manageable mainsprings. The use of lighter mainsprings may reduce the force necessary to allow the firearm to stay securely locked up. It may therefore be possible to keep the firearm locked up in battery through a variety of means, which may include mechanical means integrated into the gun frame, slide, barrel, guide rod or other interfaces such as slide lock etc. Such mechanical means may include a roller ball or index pin, or a notch in the guide rod, front guide rod bushing, and the like.

Overall, various embodiments of a recoil rebound system disclosed herein facilitate greater ease of operation by shifting the slide deceleration from the mainspring to the rebound spring stack behind the slide stop where the forces are greatly increased. The novel recoil rebound system also provides improved lock up with lighter spring pressure, improved reliability by ensuring proper slide travel, while properly addressing deceleration after slide stop to ensure clean ejection of spent case and reliable feeding of the cartridges from the magazine. It also provides for improved rebound or return energy with respect to traditional buffer springs. Furthermore, by lowering mainspring pressure, or force prior to slide stop or ejection, muzzle climb may also be reduced. This provides for a spring system capable of handling double or triple the recoil range without having to physically change a spring.

DETAILED DESCRIPTION

Figure 1:
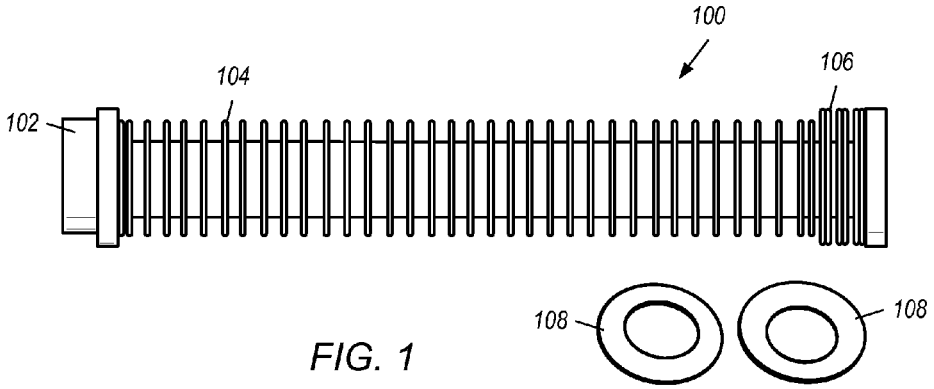
FIG. 1 is an illustration of one embodiment of a novel recoil rebound system using Belleville disc springs.
Figure 2:
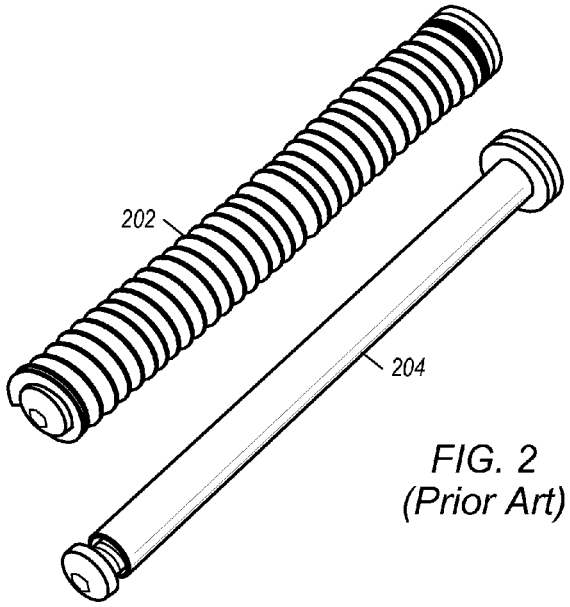
FIG. 2 (Prior Art)
FIG. 2 is an illustration of a captured spring and guide rod used in semiautomatic handguns, according to prior art.
Figure 3:
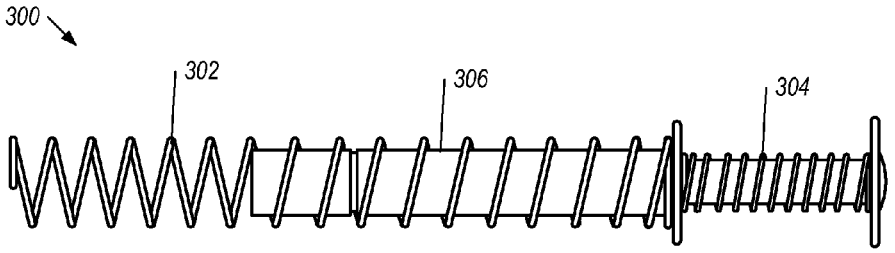
FIG. 3 (Prior Art)
FIG. 3 is an illustration of one embodiment of a dual-spring and guide rod used in semiautomatic handguns, according to prior art.
Figure 8:
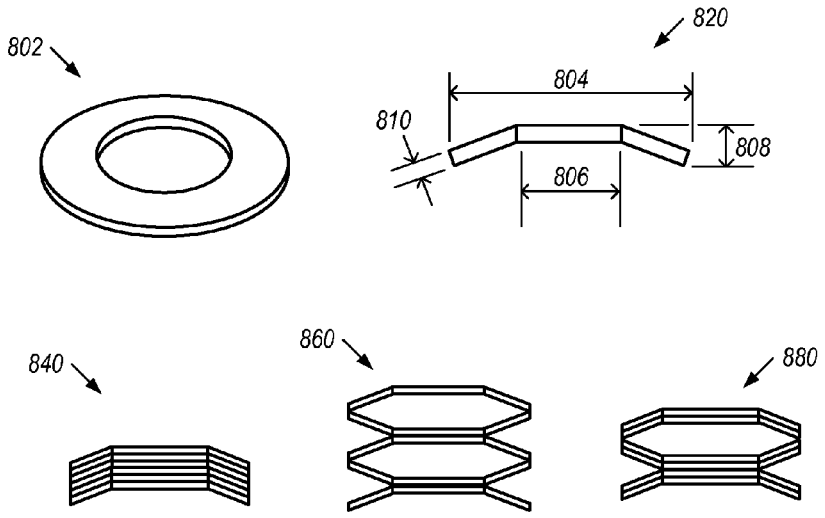
FIG. 8 (Prior Art)
FIG. 8 shows the structure and examples of Belleville disc springs, according to prior art.

In one set of embodiments, a progressive recoil action system may be designed and used in semiautomatic handguns to allow for the use of lighter springs suitable for basic operation of light loads, and higher energy density springs that provide a "rebound" effect to absorb any additional force. FIG. 1 shows one example of the basic components of a novel spring assembly 100 that may be used in a novel recoil action system, and includes a guide rod 102 having a front-end stop 110 and a back-end stop 112, a mainspring 104, and a stack 106 of Belleville springs 108 captured between mainspring 104 and back-end stop 112. The spring assembly 100 and configuration of the Belleville springs 108 will be described in further detail below. Overall, as shown in FIG. 1, a high-energy stack of Belleville disc springs may be used to modify the spring recoil assembly for the recoil action system. FIG. 8 illustrates the basic Belleville spring 802, and a side view 820 illustrating the characteristic dimensions of the Belleville spring, including maximum outer diameter 804, minimum inner diameter 806, thickness 810, and height 808. FIG. 8 also illustrates three basic stacking configurations that may be used, including a nested stack 840, inverted stack 860, and nested-and-inverted (or mixed) stack 880. The conical springs may hold large loads in small spaces, and are often used under bolt heads to maintain tension and keep the bolt from loosening. They've also been used to maintain tension at the ends of valves and bearings. Compared to Belleville washers, Belleville springs can repeatedly return to their original height once working loads are removed.

Belleville springs are designed to fit over rods (minimum inner diameter) and into holes (maximum outer diameter). They may be used singly, or stacked as shown, to increase load and deflection (the distance the spring compresses). In a nested stack 840, the load is increased by the number of springs used. In an inverted stack 860, the deflection is increased by the number of springs in the stack, while retaining the load of only one across the span of the stack. In a nested-and-inverted (mixed) stack 880, both load and deflection are increased. "Deflection at working load" refers to the distance the spring compresses when the given load is applied. "Flat Load" refers to the load at which the spring is completely compressed.

Typically, Belleville springs can support weight ranging from forty pounds to one hundred fifty pounds each, based on the thickness, diameter and height, which are shown in side view 820 of Belleville spring 802 in FIG. 8. Because of their extremely compact nature, Belleville springs may be placed behind the slide stop in a semiautomatic handgun recoil assembly, making the basic operation of the gun very easy and simple. In fact, with this combination, the mainspring weight may be reduced for even greater ease of operation. The travel behind the slide stop may be dealt with a very heavy spring stack optimized for maximum slide velocity for positive feeding of the full range of ammunition. Referring again to FIG. 1, in one embodiment, a spring stack 106 may for example include six springs each with a range starting at 40#, and ending at 70# when completely compressed, combined with a reduced power (e.g. 15#) mainspring 104. The nesting of the six springs may result in an overall multiplied force of 6×70=420#, with very little deflection or travel. Having the springs in an opposed (instead of a nested) arrangement may add deflection or travel, but does not increase the overall force of 70#. Six opposed 70# springs may yield an overall force of 70#, while effectively decelerating slide velocity or recoil. The mixed combination of nested and stacked springs may provide a very effective progressive increase of spring force.

Figure 9A:
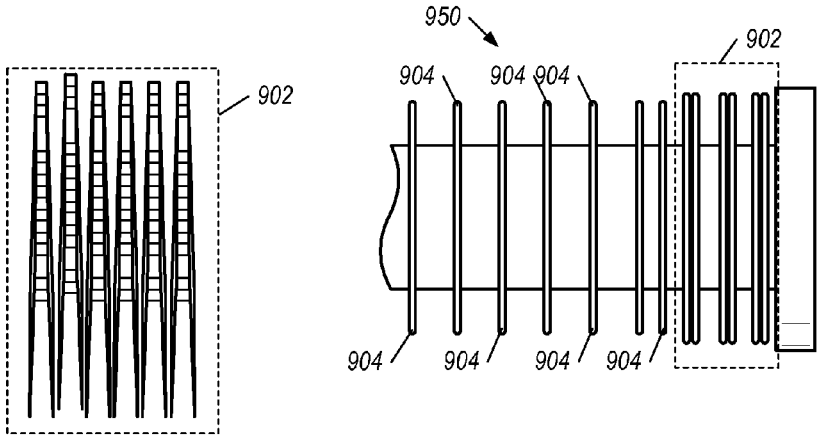
FIGS. 9A and 9B show embodiments of a novel recoil rebound system with Belleville disc spring stacks and inverted Belleville disc stacks.

FIG. 9A shows an enlarged view of an end portion 950 of the of spring assembly 100, further showing an enlarged view 902 of the spring stack 106 that includes single springs in an inverted stack for maximum travel and rebound for light loads, such as 9 mm ammunition. During testing, the rebound generated by the Belleville stack in heavier loads resulted in the slide velocity exceeding the gun's capability to feed a bullet from the magazine. As seen in FIG. 9A (and 9B), the flat spring 904 serves to fully support the inner and outer diameter of the Belleville spring stack 902 without the need for a sleeve, using the support of the collapsed spring to uniformly support the Belleville Springs 902. In some embodiments, flat springs with ground ends may be preferred. Additionally a heavier single Belleville spring or several nested springs may provide acceptable support with reduced wear in making direct contact with the flat spring, minimizing setting or deformation of the Belleville springs. This may eliminate the need for a spacer or sleeve. While using a flat spring collapsed upon itself to support the Belleville springs may reduce the life of the mainspring, during testing the buffering effect of the Belleville spring stack resulted in a negligible reduction of the mainspring's expected life span. Should the main spring weaken, the Belleville stack may still be sufficient to absorb added recoil that might otherwise damage the gun.

Figure 10:
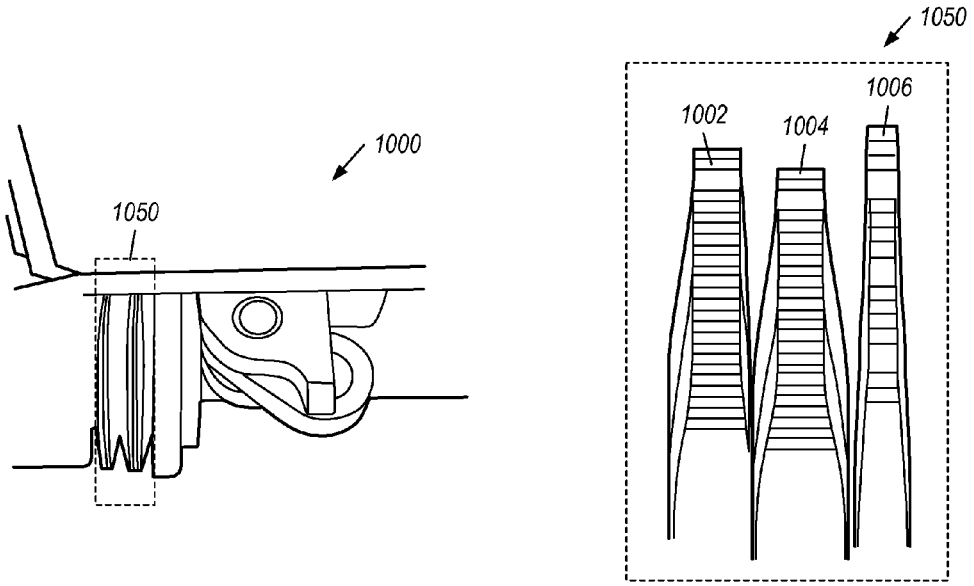
FIG. 10 shows one embodiment of a novel recoil rebound system with Belleville disc spring stacks and inverted Belleville disc stacks used for firing loads generating different recoil forces.

In one set of embodiments, the spring stack may be adjusted to obtain a desired spring stack combination for each different application. For example, FIG. 10 illustrates a partial diagram of a gun assembly 1000 with a compressed coil spring prior to a Coffman rebound Belleville stack 1050 being engaged. In the case of a 45 Coffman, the desired combination may be achieved by placing two (2) nested springs 1002 and two more nested springs inverted 1004 followed by a single inverted spring 1006, as shown in stack 1050 in FIG. 10. The single spring would compress from 40 pounds to 70 pounds flat, followed by 160 pounds to 280 pounds flat. Under complete compression, this provides 350 pounds of recoil absorption/rebound energy. In other words, a 45 Coffman capable of firing a 185-grain bullet traveling at 1,750 fps for 1,258 ft-lbs may interchangeably fire standard 45 ACP and even 45 GAP with the use of a spring stack of standard coil spring with Belleville springs stacked according to the arrangement shown in 1050.

Figure 35:
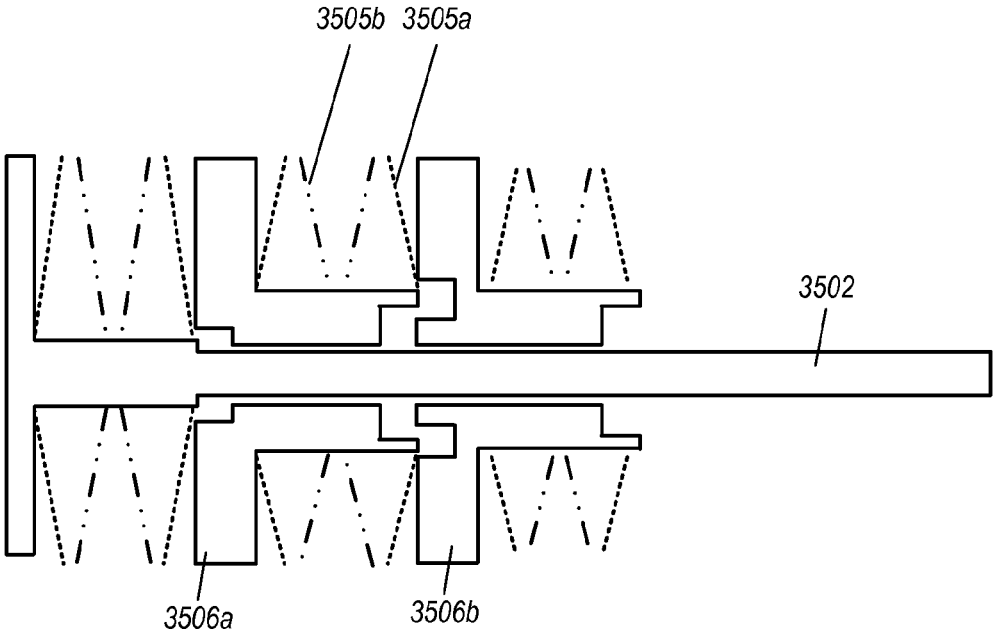
FIG. 35 is an illustration of a Belleville progressive spring stack with fully supported guide rod end post and sleeve/piston with fully supported flange and Belleville springs, according to one embodiment.

FIG. 35 shows a Belleville Progressive spring stack with fully supported guide rod end post 3502 and sleeve/piston with fully supported flange 3506*a*/3506*b*, and Belleville springs 3505*a*/3505*b* (illustrated by all the dashed lines). While there may be various combinations of progressive spring stack, it is preferred to have the inner portion of the Belleville Spring making contact with the post, sleeve, piston or flange where they are the strongest. This is especially true of the guide rod end post whereby for low cost manufacturing it may be preferred to have a thin post constructed of stamped metal and attached with a rivet for example. This also allows the "Flange" thickness necessary for support to be greatly reduced, resulting in more Belleville or other springs. It is also preferred to have a mechanical means of limiting the amount of compression the Belleville springs undergo. This facilitates not only the incorporation of different spring thicknesses and associated spring forces or pounds of force, but is allows the progressive spring stack to be engineered for a desired mean failure rate, especially important for the military.

Figure 36:
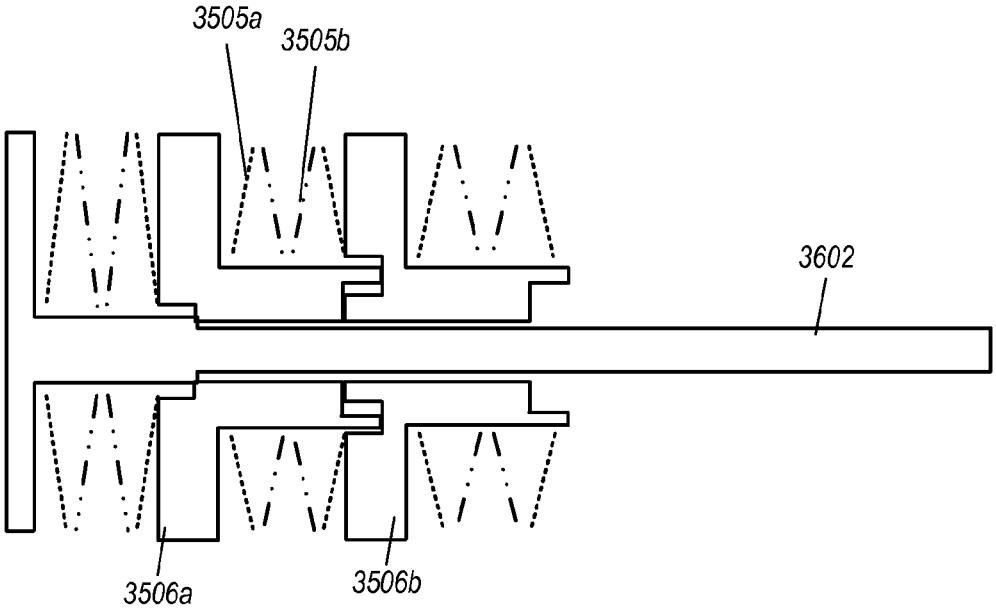
FIG. 36 is an illustration of a progressive spring stack compressed fully to the mechanical stops, according to one embodiment.

FIG. 36 shows the progressive spring stack from FIG. 35 compressed fully to the mechanical stops. Belleville spring manufacturers claim million plus cycles if the amount of loading is mechanically limited. This is to say that a spring stack that is only undergoing 50% compression as shown in FIG. 36 will far outlast one being subjected to one at 100% compression. Additionally, one being subject to 200%, which is to say a Belleville spring flat load rating of 70 pounds for example, being subjected to a 140 pound impact will undergo immediate setting, whereby the spring may go flat losing its shape or memory. This may be deliberately done to have a telltale method for the manufacturer to determine if +P++ ammunition has been fired with the firearm. In one set of embodiments, a Belleville spring stack may be permanently captured as the properly matched Belleville springs can have a cycle life ranging from several hundred thousand cycles to a million cycles. This far outlasts the barrel life that most, including the military would consider to be around 10,000-20,000 rounds. Such a permanent fixture may prevent the user from stacking the springs in a life-threatening manner where the gun may not cycle properly or may damage the firearm. This is especially true of military and law enforcement firearm operators. The main spring, considered to be a wear item can still be replaced every 5,000 to 10,000 rounds or as required.

Figure 4:
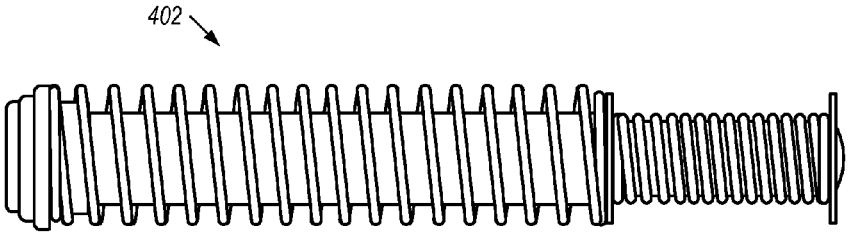
FIG. 4 (Prior Art)
FIG. 4 is an illustration of another embodiment of a dual-spring and guide rod used in semiautomatic handguns, according to prior art.
Figure 5:
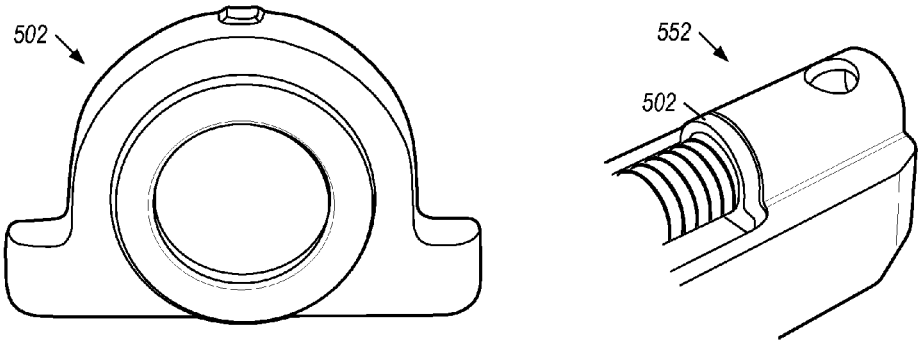
FIG. 5 (Prior Art)
FIG. 5 is an illustration of one embodiment of an impact buffer used with a spring and guide rod in semiautomatic handguns, according to prior art.
Figure 6:
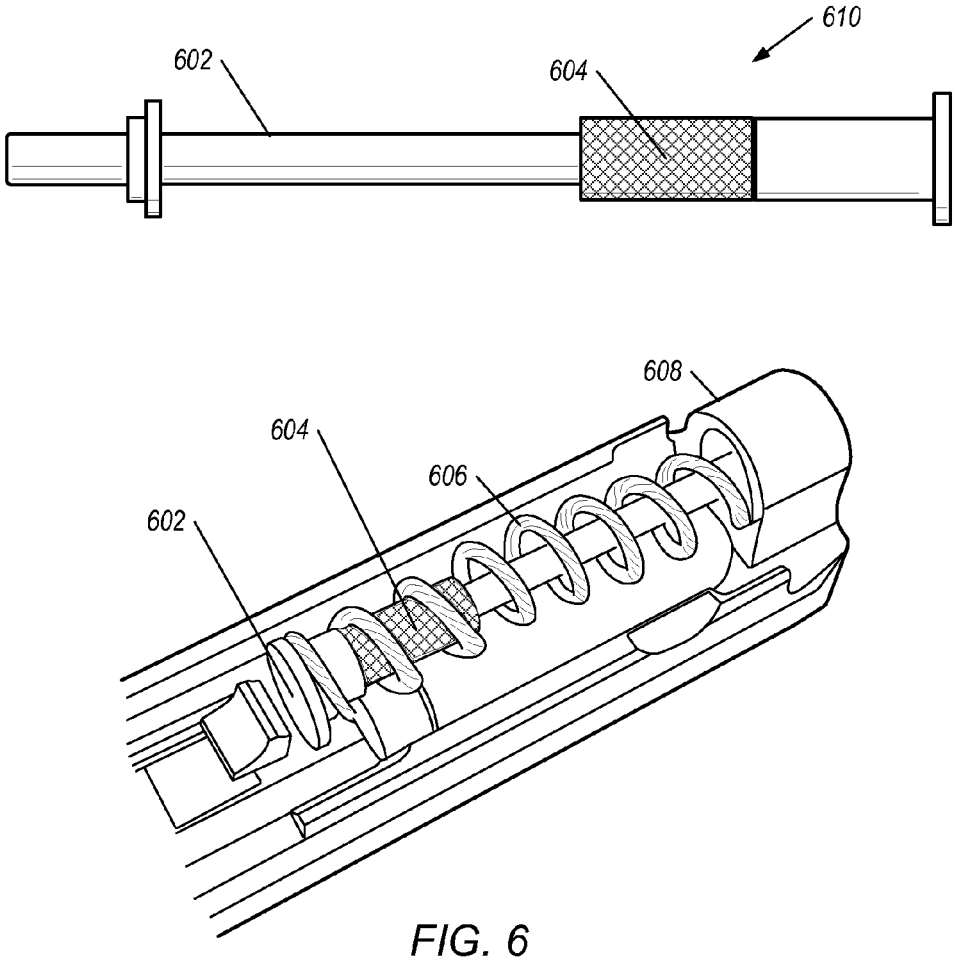
FIG. 6 (Prior Art)
FIG. 6 is an illustration of an elastomer impact buffer used with a spring and guide rod in semiautomatic handguns, according to prior art.
Figure 7:
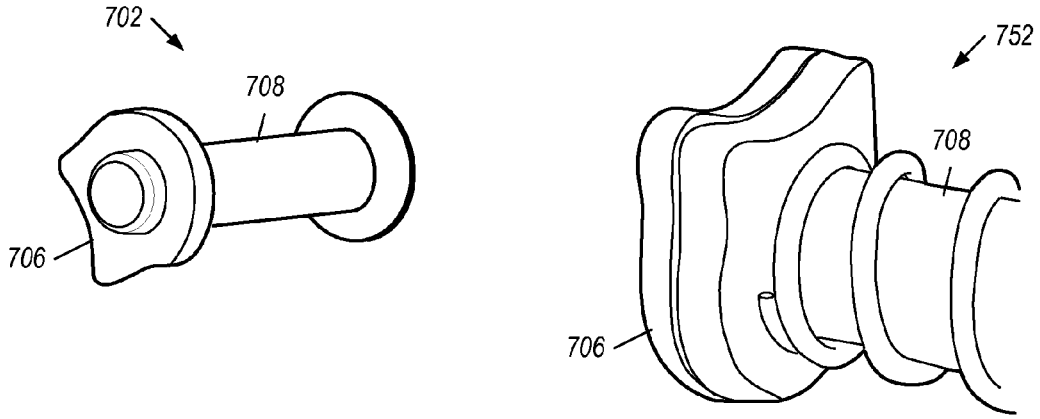
FIG. 7 (Prior Art)
FIG. 7 is an illustration of another embodiment of an impact buffer used with a spring and guide rod in semiautomatic handguns, according to prior art.
Figure 9B:
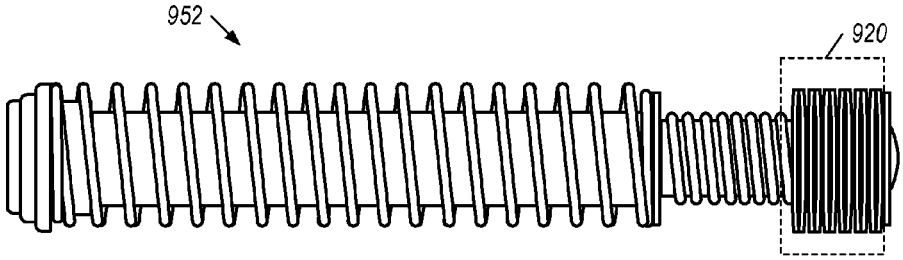
Figure 11:
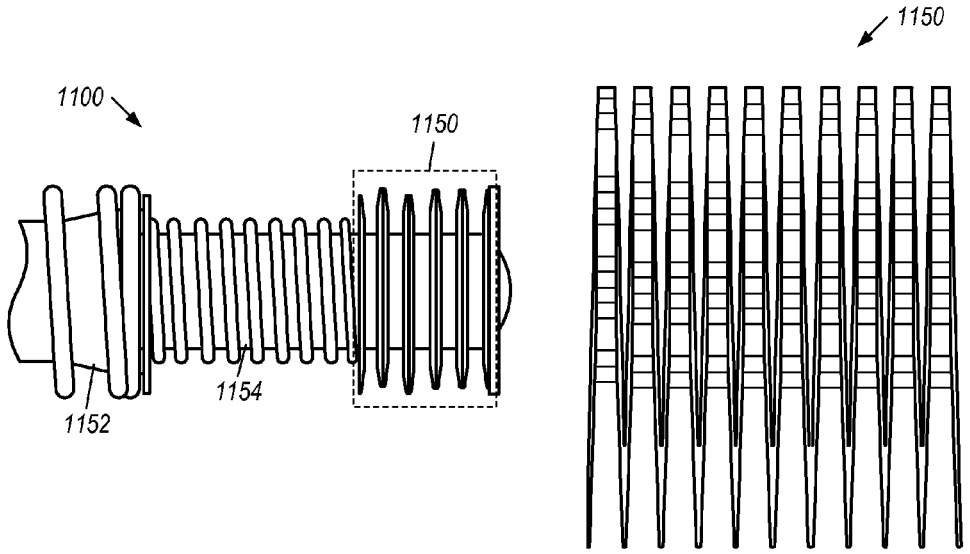
FIG. 11 shows one embodiment of a novel recoil rebound system with a dual-spring and guide rod modified with Belleville disc spring stacks.
Figure 12:
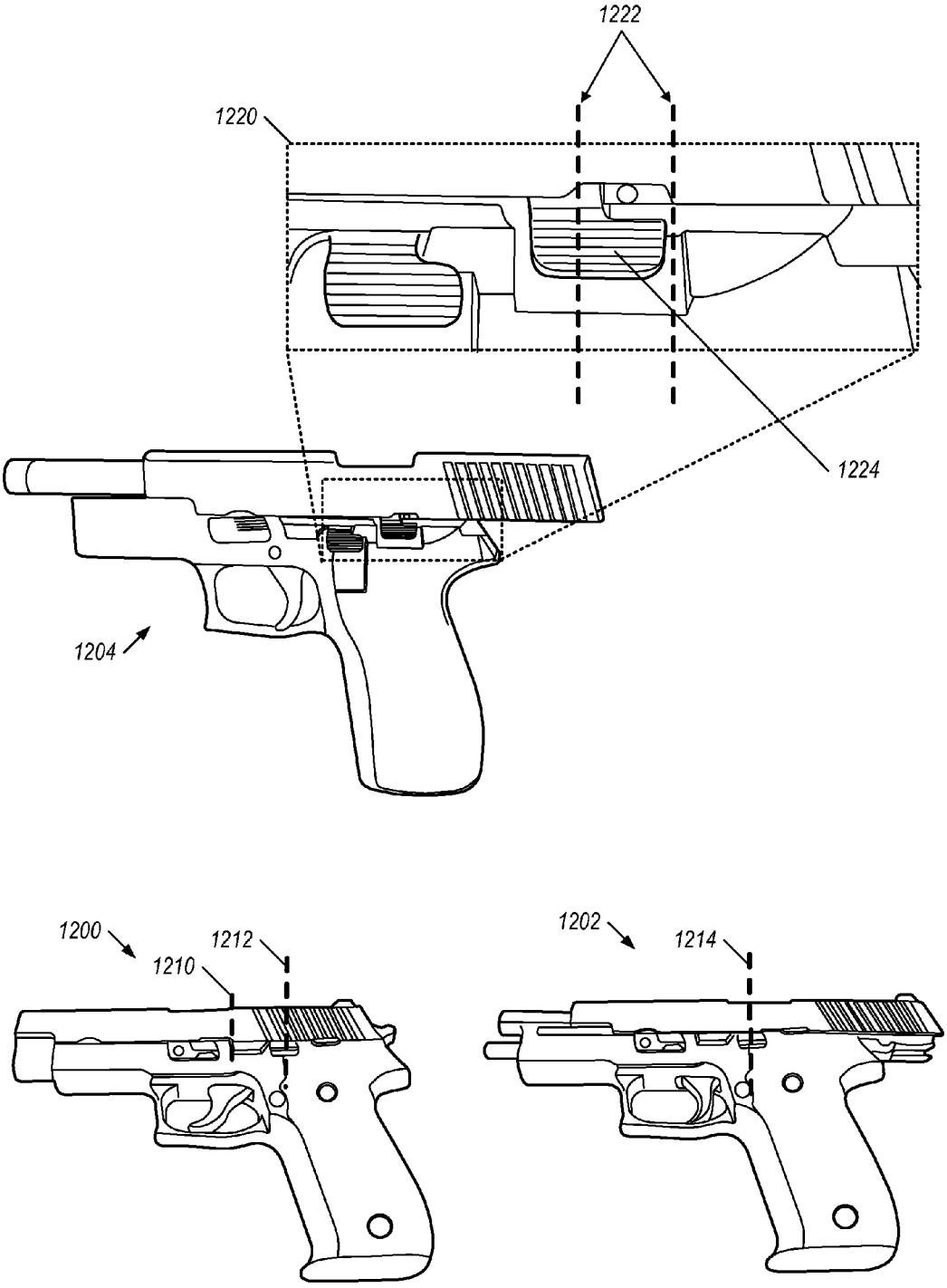
FIG. 12 (Prior Art)
FIG. 12 shows illustrations representing various states of a semiautomatic handgun to illustrate over-travel with respect to the slide-stop, according to prior art.
Figure 13:
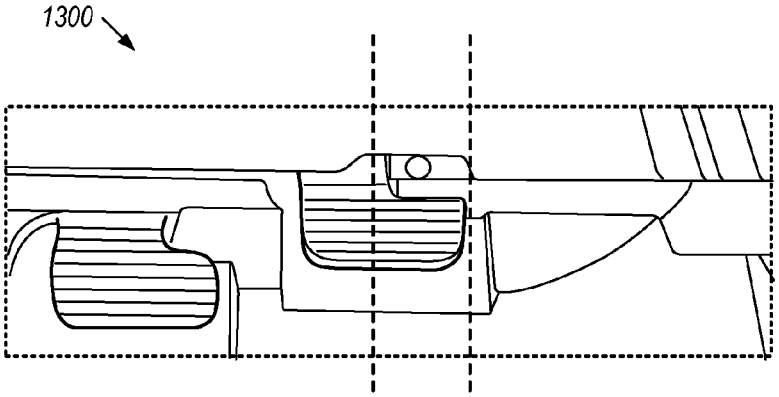
FIG. 13 (Prior Art)
FIG. 13 shows a close-up picture of the slide-stop from FIG. 12, according to prior art.
Figure 14:
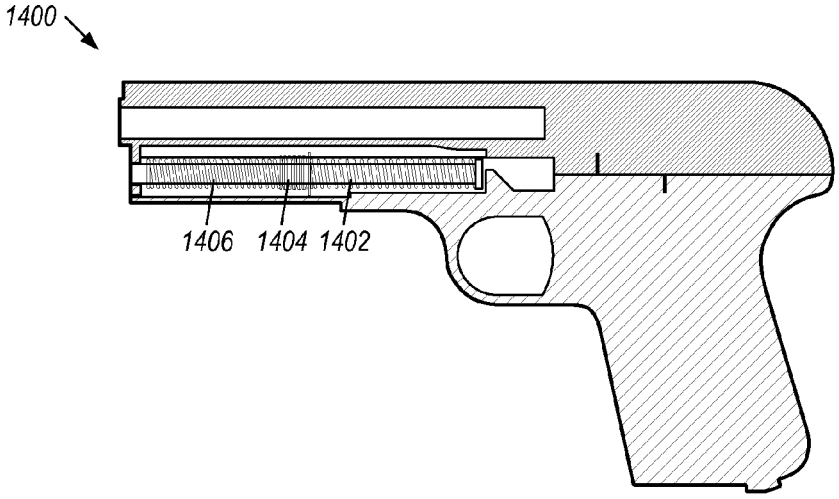
FIG. 14 (Prior Art)
FIG. 14 is an illustration of a impact buffering recoil mechanism with inner sleeve adapted to a semiautomatic handgun, according to prior art.
Figure 14:
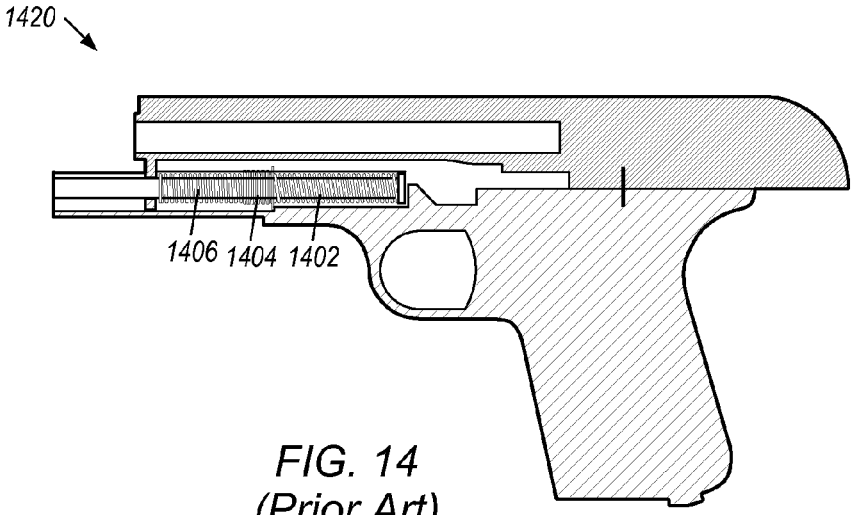
FIG. 14 (Prior Art)

Referring again to FIG. 12, the Coffman rebound spring may reside behind the slide stop lever 1224 to ensure normal handling and operation with the mainspring, or easier operation with a lighter mainspring. The rebound springs may engage after the slide stop lever but before the frame stop, as indicated by the dashed lines in FIG. 13. In other words, over travel beyond the slide stop lever is where the super high energy Belleville rebound stack may be engaged. FIG. 9B shows a captured spring assembly 952 (similar to the captured spring assembly from FIG. 4) enhanced with a Coffman rebound stack 920. A somewhat enlarged and more detailed view of the end of captured spring assembly 952 is shown in FIG. 11. As illustrated in FIG. 11, spring assembly portion 1100 includes a Belleville rebound stack 1150, a detailed view of which is shown to the right. Stack 1150 includes ten 140# springs opposed for maximum deflection at 140#. Conversely, if these springs were nested, they would result in a total force absorption of 1,400 lbs. FIG. 14 illustrates operation of a recoil rebound system in a handheld firearm according to prior art. In a "disengaged" position 1400, a heavy spring 1406, Belleville spring stack 1404 and light spring 1402 are in a relaxed state. In an "engaged" position 1420, when springs 1406 and 1402 fully compress just past the slide lock/release, then the Belleville rebound spring stack 1404 may engage, but may not be fully supported when coming into contact with the frame, leading to jamming and/or malfunction. Just prior to the Belleville rebound spring stack 1404 being fully compressed or flat, the slide and frame stop engaging.

Figure 15:
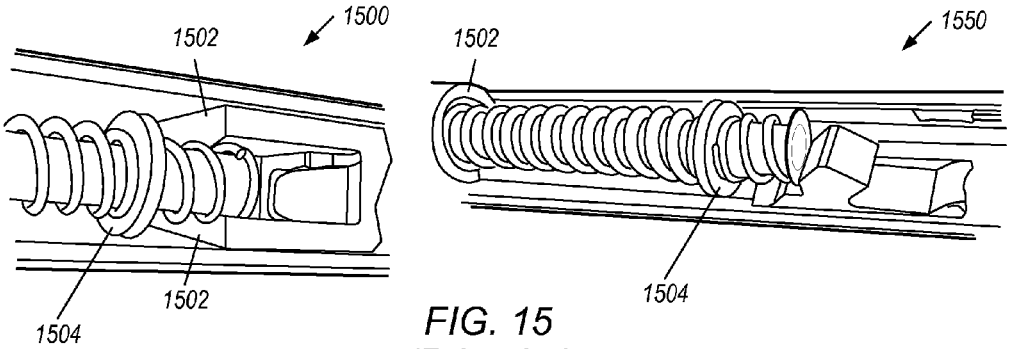
FIG. 15 (Prior Art)
FIG. 15 shows illustrations depicting a close-up of a frame slide-stop inside a semiautomatic handgun that uses an impact buffering recoil mechanism, according to prior art.
Figure 16:
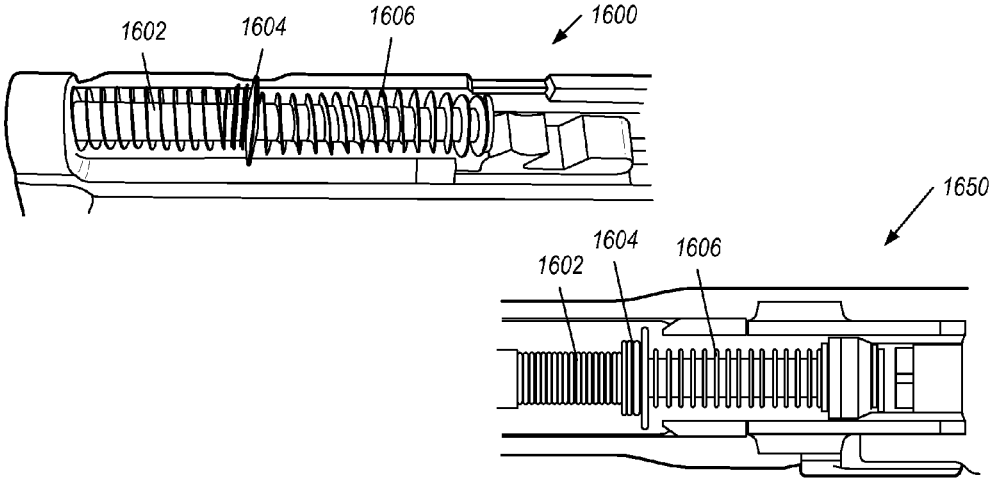
FIG. 16 (Prior Art)
FIG. 16 shows illustrations depicting a top view of an impact buffering recoil mechanism, according to prior art.
Figure 17:
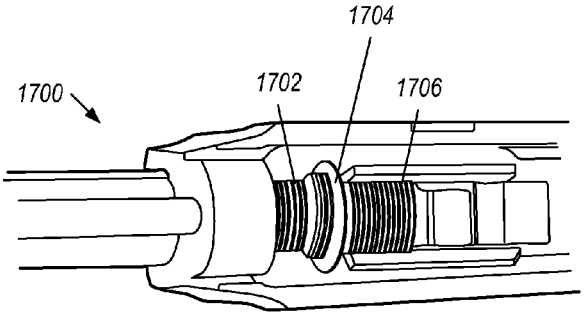
FIG. 17 (Prior Art)
FIG. 17 shows illustrations depicting another view of the impact buffering recoil mechanism illustrated in FIG. 16, according to prior art.

FIGS. 15, 16 and 17 illustrate examples of configurations in which the Belleville springs are not fully supported when making contact with the frame & slide stop. Because the top of both the slide stop and frame stop are open and not supported 360 degrees along the outer circumference, a Belleville spring stack may be prone to twisting at these unsupported areas. This may lead to pinching, binding and excessive wear on guide rods, springs, slide and frame of the gun, which may cause the firearm to fail to cycle properly, an unacceptable threat in life safety. FIG. 15 provides an illustration of the frame slide stop 1502 in the context of a partial diagram of a firearm assembly in a first view 1500, with a second view 1550 providing an illustration of the slide stop 1502. FIG. 16 illustrates a first view 1600 of a partial diagram of a firearm assembly showing the heavy spring 1602, Belleville ring stack 1604 and light spring 1606 in a relaxed state. A second view 1650 shows the compressed heavy spring 1602, Belleville ring stack 1606, and compressed light spring 1604. FIG. 17 provides yet another view 1700 of the compressed heavy spring 1702, Belleville spring stack 1704, and compressed light spring 1706. As seen in the examples shown in FIGS. 15, 16, and 17, the Bellville springs may twist or bend over the bottom of the frame, which damages cover plate. For example, Bellville springs can cause wear or breakage of the locking block if used in Sig Sauer P226 style firearms, and may result in premature wear of polymer frame Glock or Smith and Wesson M&P models. The side view 1600 of the partial assembly shown in FIG. 16 shows Bellville spring 1604 bending upon contact with the slide stop (frame).

Figure 18:
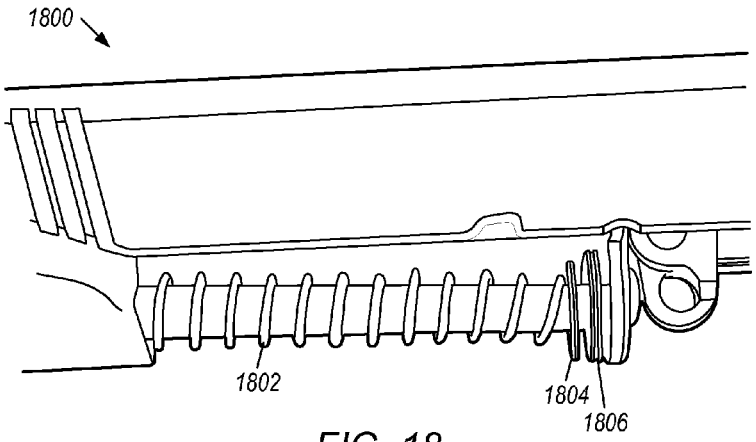
FIG. 18 shows an illustration of one example of a novel recoil rebound system in a model 1911-A1, .45 caliber handgun.
Figure 19:
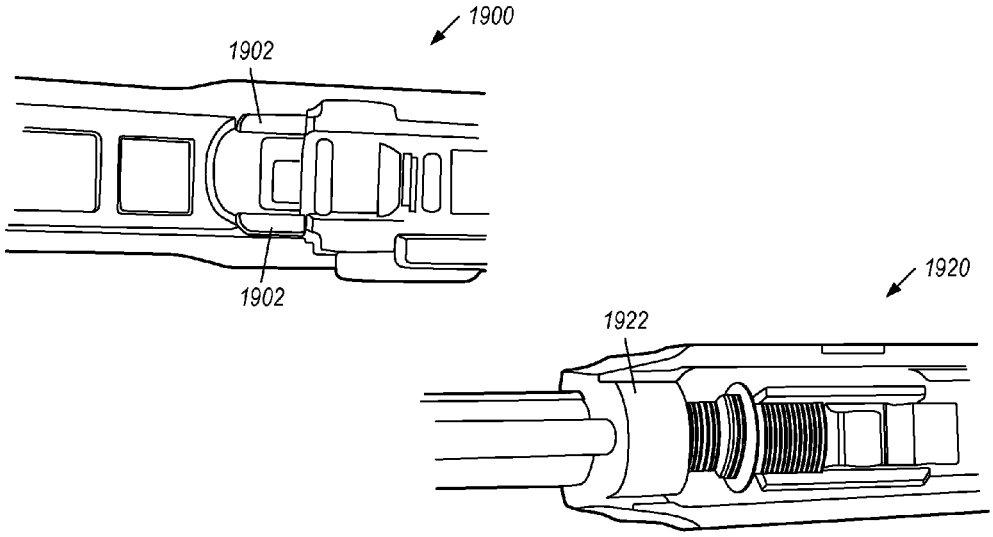
FIG. 19 (Prior Art)
FIG. 19 shows illustrations of an inner sleeve with Belleville flat spring before fail over to frame and slide stop, according to prior art.

FIG. 18 is an illustration of a partial firearm assembly showing the uncompressed spring for a model 1911-A1, 45 caliber ACP firearm, with spring 1802, and Belleville ring stacks 1804 and 1806. FIG. 19 is a partial illustration of a first component 1900 of a firearm assembly showing the frame stop 1902, with a partial illustration of a second component 1920 showing the slide stop 1922 with respect to the springs and Belleville ring stack. A Coffman rebound spring set may be designed to compress the Belleville spring stack by 95% before coming to final rest against the slide and frame stop.

Figure 20:
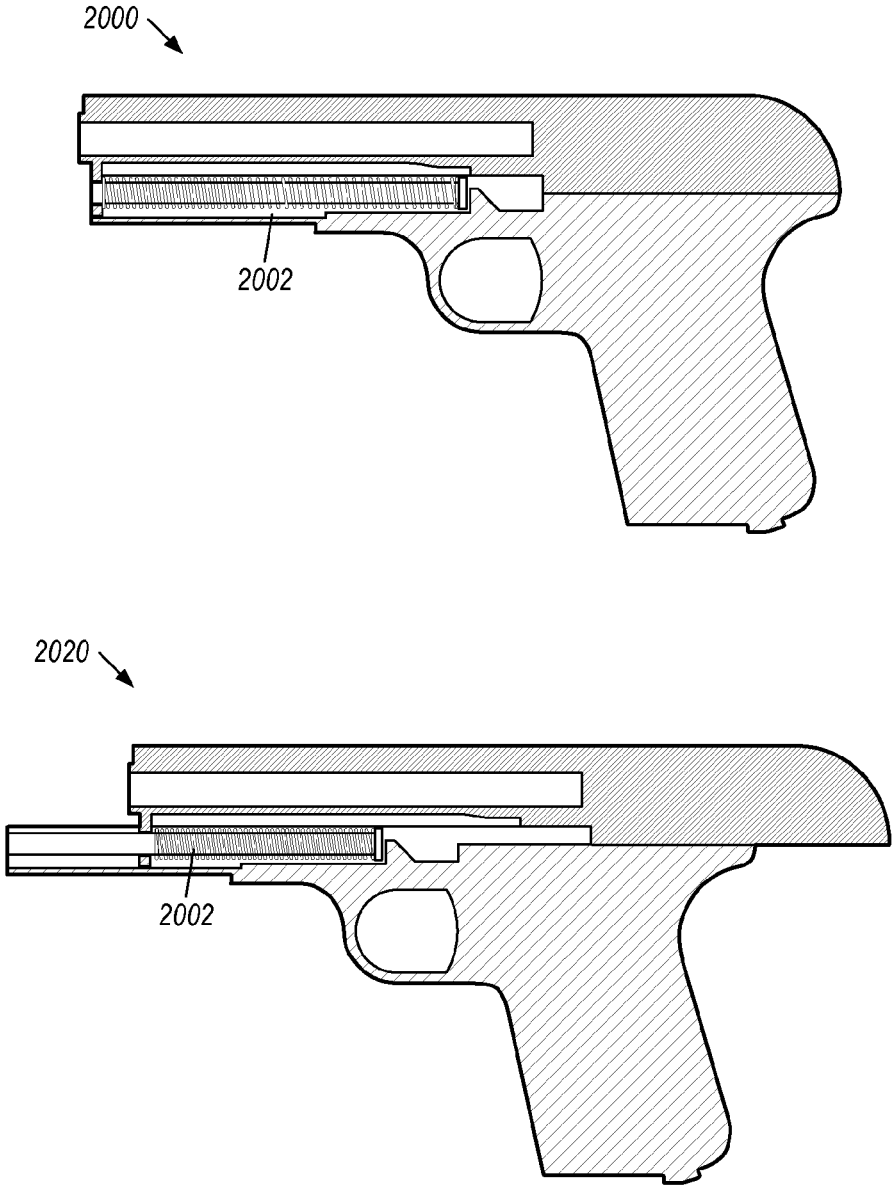
FIG. 20 (Prior Art)
FIG. 20 illustrates a standard guide rod recoil system inside a semiautomatic handgun before and after travel, according to prior art.
Figure 21:
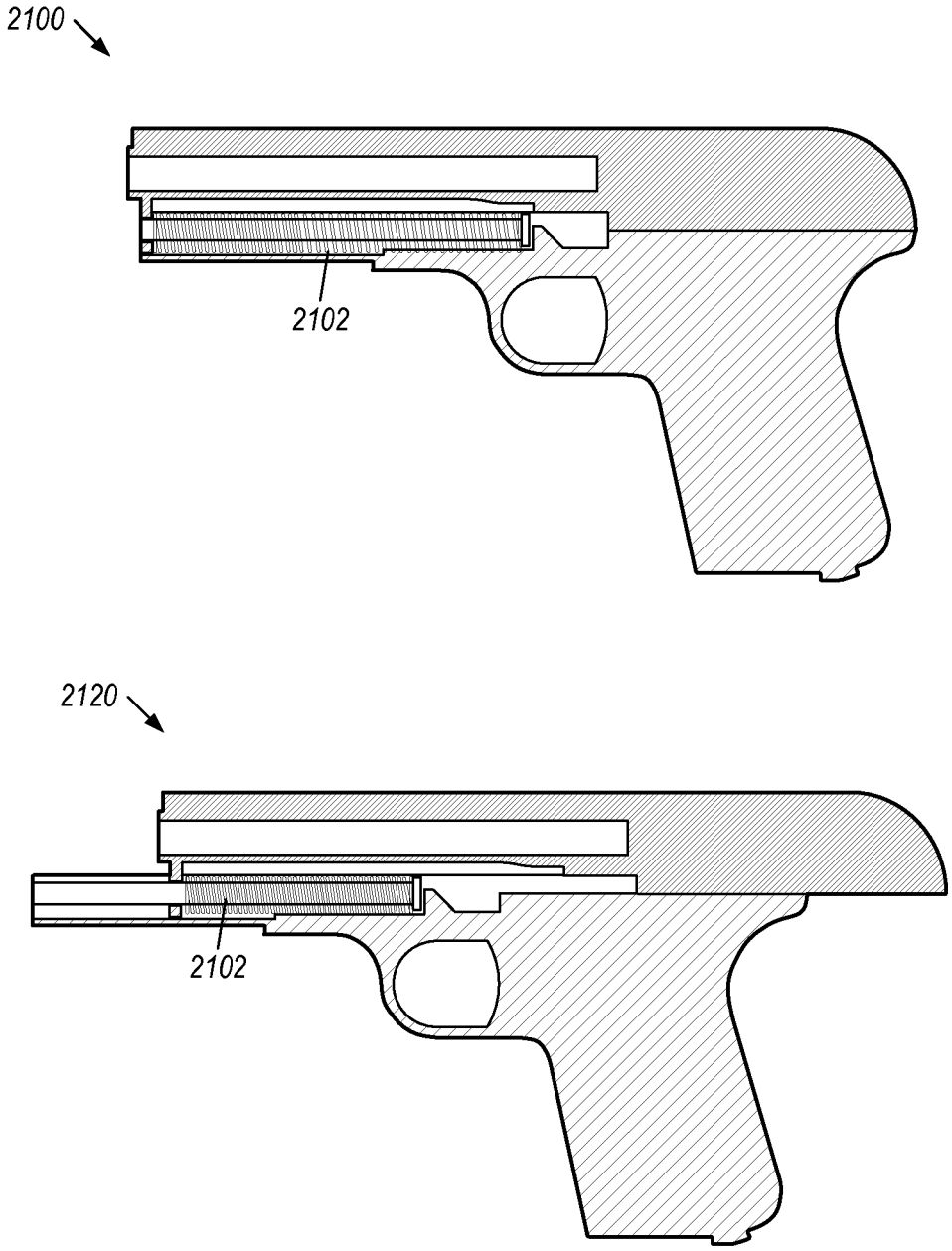
FIG. 21 (Prior Art)
FIG. 21 illustrates a recoil rebound system inside a semiautomatic handgun before and after travel, according to prior art.
Figure 22:
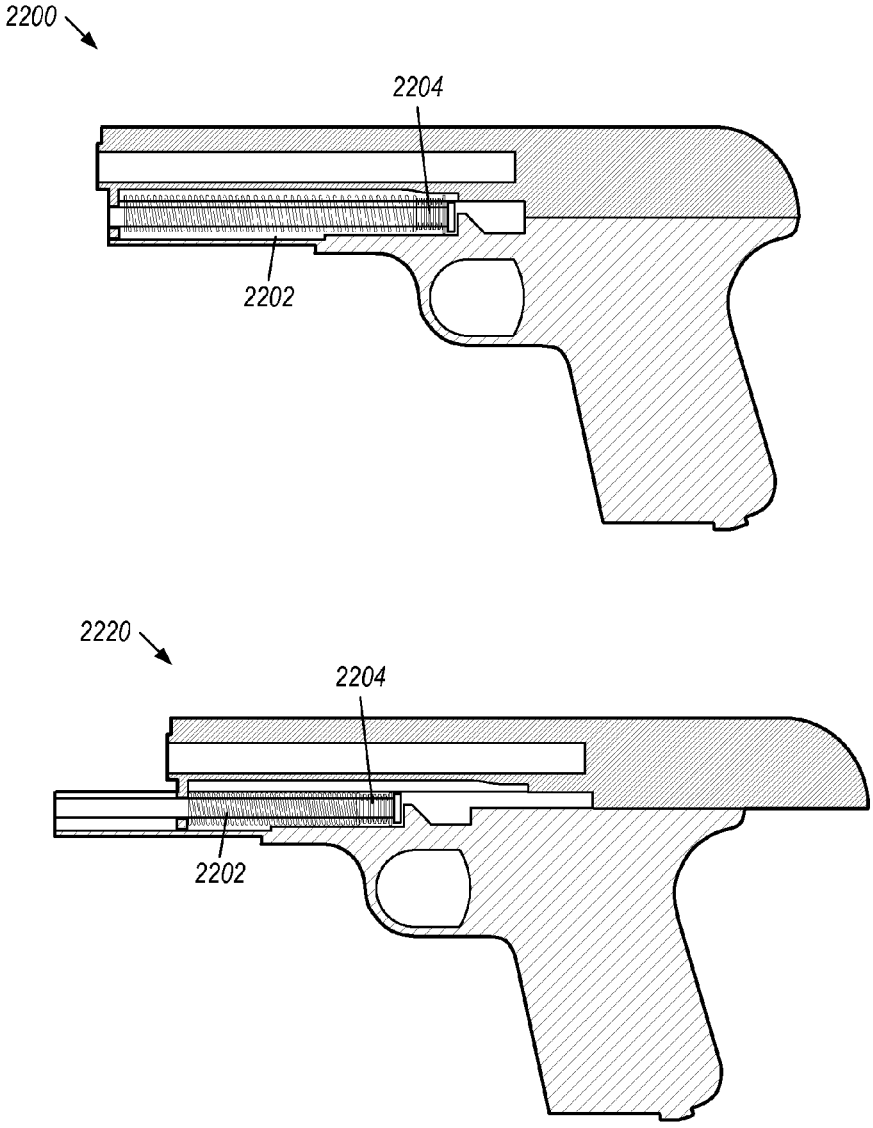
FIG. 22 illustrates the operation of a novel recoil rebound system inside a semiautomatic handgun before and after travel, according to one embodiment.

FIG. 20 shows a standard guide rod recoil system, where in a first operating state 2000 before firing, the spring 2002 is slightly compressed to maintain positive slide engagement, whereas in a second operating state 2020 upon firing the firearm, the spring 2002 does not get fully compressed. FIG. 21, illustrates operation of a related-art system, where in a first operating state 2100 before firing, the spring 2102 is slightly compressed to maintain positive slide engagement, and in a second operating state 2120 upon firing the firearm, the spring 2102 is fully compressed and flat. FIG. 22, illustrates operation of the Coffman recoil rebound system configured with a rebound stack of Belleville springs 2204,where in a first operating state 2200 before firing, the spring 2202 is slightly compressed to maintain positive slide engagement, and in a second operating state 2220 upon firing the firearm, the spring 2202 is fully compressed and flat together with a rebound stack of Belleville springs 2204.

Moving the Belleville spring stack to the end post of the guide rod reduces the Belleville spring travel or movement along the guide rod and allows the Belleville spring to be fully supported which effectively eliminates excessive wear and binding. Referring again to FIG. 11, a sleeve 1152 or sleeve/piston 1152/1154 may provide full support of the Belleville spring stack 1150 were it makes contact with the springs in front. In theory, one might not want to direct all of the recoil absorption energy into the guide rod post frame support, preferring to allow excessive forces to be absorbed by the slide and frame stop. Present testing of Coffman Huber Magnum loads however have yet to uncover any issues transferring all of the recoil energy into the guide rod post when using various embodiments of a Belleville spring stack. Testing has been carried out for Glock, Sig Sauer, FNP, Springfield, Taurus and Beretta firearm designs. Referring again to FIG. 19, the spring stack or sleeves may be tuned to put all of the recoil energy into the guide rod post, or fail over to the frame and slide stop at a predetermined percentage of compression or equivalent pound force associated with this amount of compression/travel. This may be adjusted to meet what is determined to be acceptable for the guide rod post of the frame to handle, and gives firearm manufacturers the ability to engineer either approach.

Figure 23:
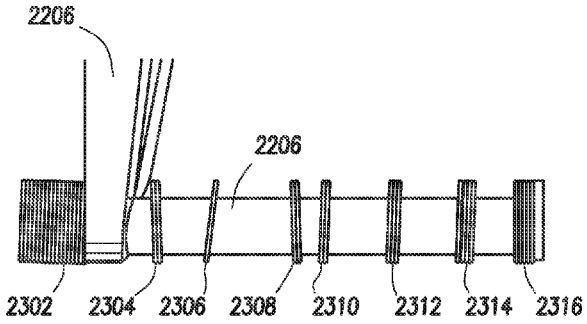
FIG. 23 is an illustration of a Smith & Wesson guide rod configured with a novel recoil rebound system for the M&P 9MM pistol, according to one embodiment.

FIG. 23 illustrates one possible arrangement of Belleville ring stacks 2304, 2306, 2308, 2310, 2312, 2314, and 2316 situated next to a mainspring 2302 on a guide rod 2206. To illustrate the separate stacks, a pair of pliers 2206 is shown to be holding spring 2302 in place. The arrangement shown in FIG. 23, when permanently captured—that is, when a user cannot remove the Belleville ring stacks 2304 to 2316 from the guide rod—may enable the gun manufacturer to determine if a firearm has been subjected to a higher than normal power factor load. With the demand for smaller and more compact firearms, many manufacturers are meeting this demand that are rated for 9 mm for example, but have warnings that the firearm is not rated for 9 mm +P or +P+ loads. With the permanently captured Belleville spring system, the single spring may be sized to function with the standard pressure load, but undergo a "setting", whereby the spring is flattened out no longer maintaining its memory when subjected to +P loads, or loads higher that what the firearm is rated for. This "telltale" method with a serialized guide rod matching the firearm may provide a manufacturer with the means to determine whether non authorized ammunition has been used, and deny a warranty claim due such use of non authorized ammunition. The same system may be employed for members of the military and law enforcement. For example, in one set of embodiments, the inserted "telltale" spring may become flat after the 10,000-20,000 round mean failure rate that the military often requires. During routine inspection, it may easily be determined that the spring assembly needs to be replaced.

Figure 24:
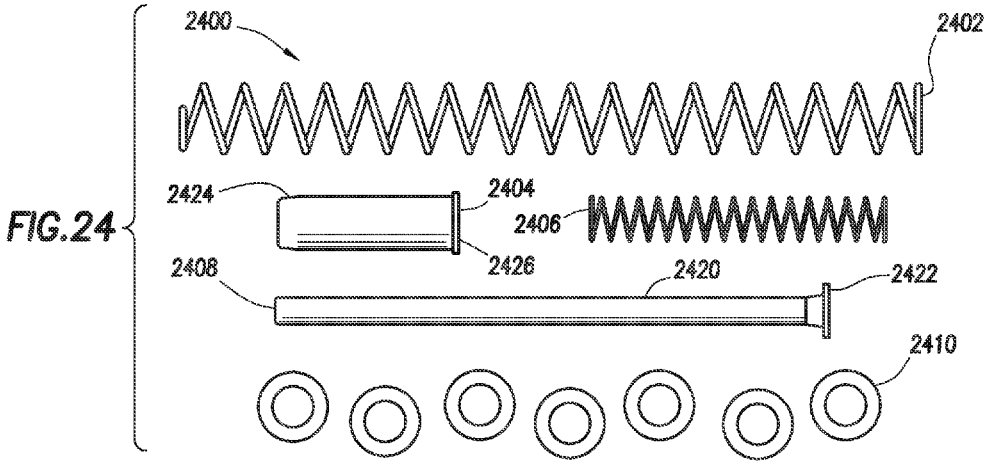
FIG. 24 is an illustration of an exploded view of a progressive spring stack with fully supported guide rod end post and sleeve, according to one embodiment.
Figure 25:
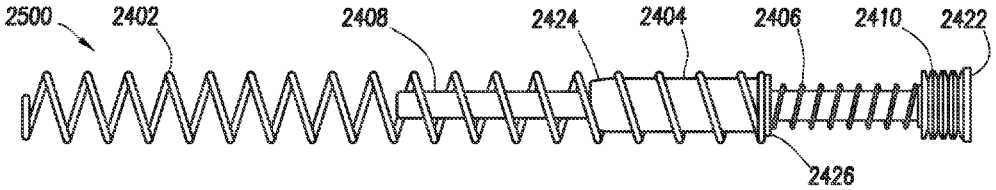
FIG. 25 is an illustration of an assembled view of progressive spring stack with fully supported guide rod end post and sleeve, according to one embodiment.
Figure 26:
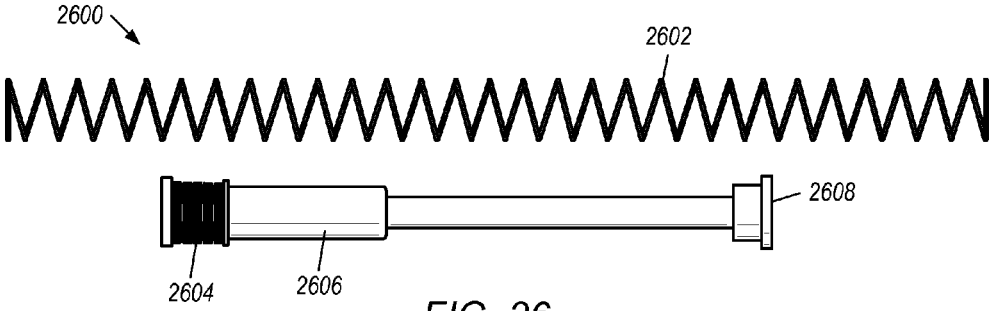
FIG. 26 is an illustration of an exploded view of a progressive spring stack with fully supported guide rod end post and sleeve adapted for Beretta 92 and clones, according to one embodiment.
Figure 27:
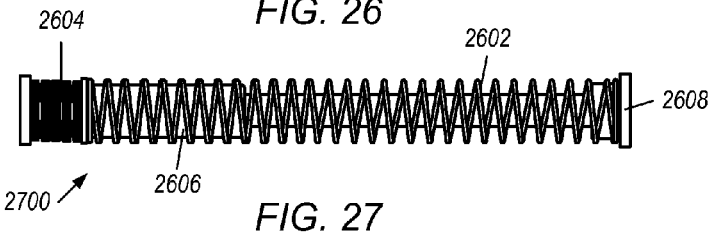
FIG. 27 is an illustration of an assembled view of a progressive spring stack with fully supported guide rod end post and sleeve adapted for Beretta 92 and clones, according to one embodiment.
Figure 28:
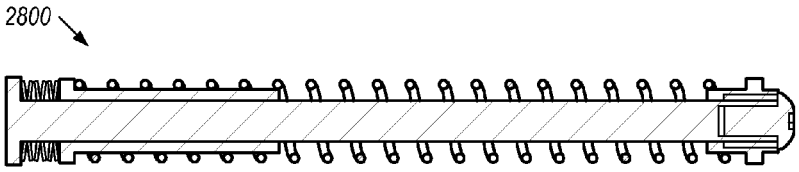
FIG. 28 is an illustration of a longitudinal cross-section of the assembled view of a progressive spring stack with fully supported guide rod end post and sleeve, according to one embodiment.
Figure 29:
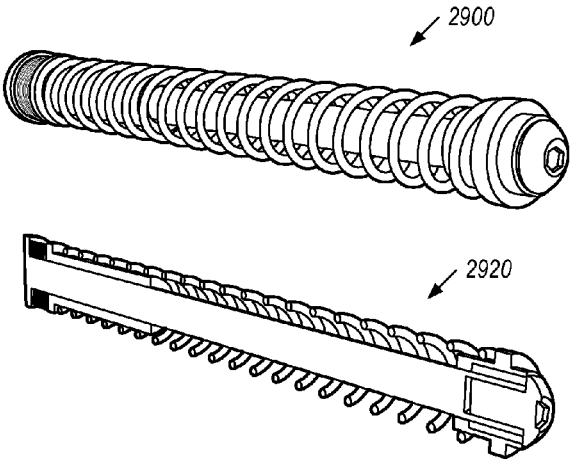
FIG. 29 is an illustration of a quartering view and cross-sectional view of a progressive spring stack with fully supported guide rod end post and sleeve adapted for Beretta 92 and clones, according to one embodiment.
Figure 30:
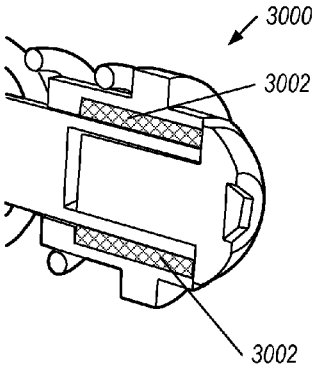
FIG. 30 is an illustration of a magnified view of the tip end of the progressive spring stack shown in FIG. 29, according to one embodiment.

FIG. 24 shows various components 2400 of a progressive spring stack with fully supported guide rod end post 2408 and sleeve 2404. The spring stack also includes a specified number of Belleville rings 2410, mainspring 2402, and secondary spring 2406. FIG. 25 shows an assembled view 2500 of the components of the progressive spring stack. Considering the Beretta Model 92 or clones, for example, if the main spring is not replaced when weakened, or excessively hot ammunition is fired, metal fatigue leading to the slide breaking in half may occur. FIG. 26 shows an exploded view 2600 of a progressive spring stack 2604 with fully supported guide rod end post 2608 and sleeve 2606 with a mainspring 2602 for a Beretta Model 92 firearm. FIG. 27 shows an assembled view 2700 of the progressive spring stack 2604 with fully supported guide rod end post 2608 and sleeve 2606 with a mainspring 2602 for a Beretta Model 92 firearm. FIG. 28 shows a cutaway view 2800 of the assembly from FIG. 27. FIG. 29 shows a full quartering view 2900 as well as a cutaway quartering view 2920 of the assembly from FIG. 27. FIG. 30 shows a magnified view of collet 3000 of the tip of the assembly from FIG. 27. To better facilitate the increased slide velocity and reliability, a bronze bearing impregnated with either oil or graphite, or a polymer may be used on inner sleeve 3002. This novel approach insures that if a user fails to change the mainspring, the Belleville stack will continue to buffer the impact so as not to damage the firearm until such a time that the mainspring becomes too weak to maintain proper lock-up, forcing the user to replace the mainspring. This "Fail Safe" approach improves the life safety of the firearm even if not properly maintained or if used beyond its designed parameters such as the use of hot ammunition.

Figure 31:
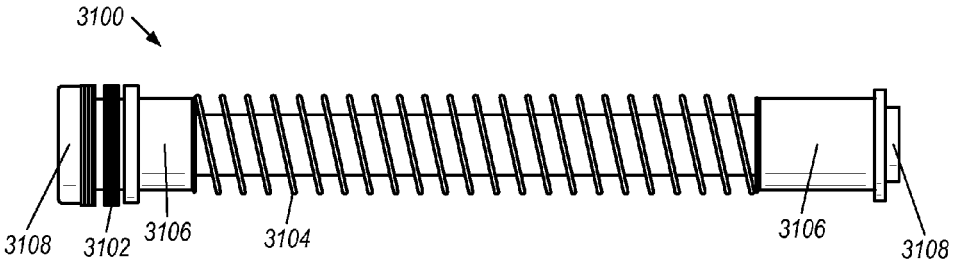
FIG. 31 is an illustration of a flatwire/Belleville progressive spring stack with fully supported guide rod end post and sleeve, according to one embodiment.
Figure 32:
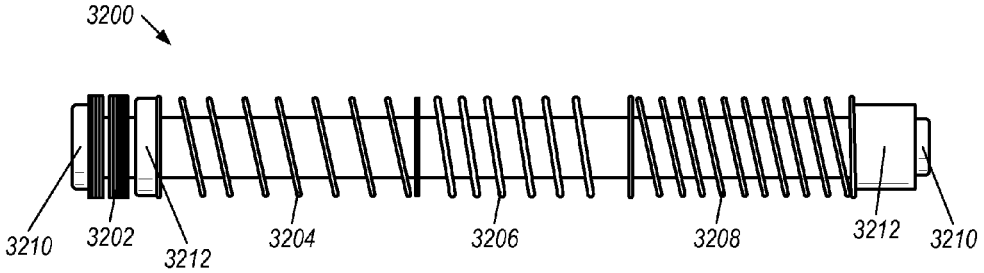
FIG. 32 is an illustration of a triple progressive flatwire with triple progressive Belleville progressive spring stack with fully supported guide rod end post and sleeve, according to one embodiment.
Figure 33:
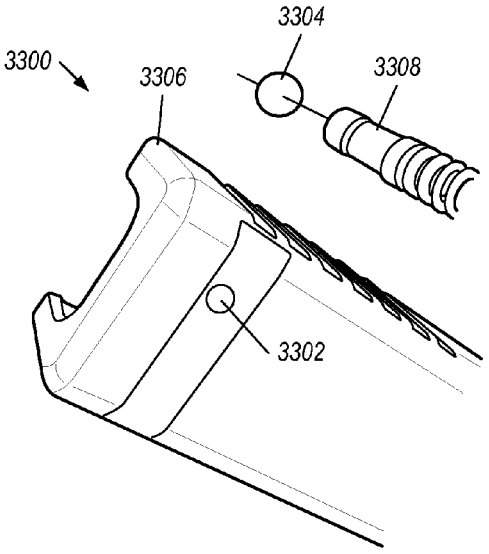
FIG. 33 is an illustration of a spring roller ball assembly that provides positive lock-up pressure against the pistol frame, according to one embodiment.
Figure 34:
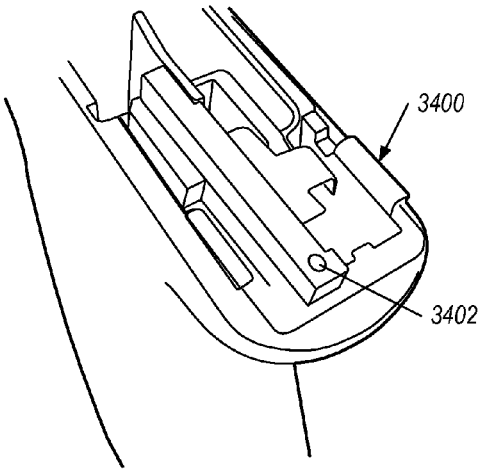
FIG. 34 is an illustration of a spring roller ball indentation in the pistol frame that allows for positive lock-up, according to one embodiment.

FIG. 31 shows a side view 3100 of a flatwire/Belleville Progressive spring stack 3102 with fully supported guide rod end post 3108 and sleeve/piston 3106 with mainspring 3104 for Glock, S&W, M&P and other similar type firearms. FIG. 32 shows a side view 3200 of a triple progressive flatwire with triple progressive Belleville progressive spring stack 3202 with fully supported guide rod end post 3210 and sleeve/piston 3212 with springs 3204, 3206 and 3208 for Glock, S&W, M&P and other similar type firearms. FIG. 33 shows a partial drawing of a firearm assembly 3300 with spring roller ball assembly 3304/3308 that provides positive lock-up pressure against the frame. The spring roller ball assembly 3304/3308 held in place by rear sight 3302 provides positive lock-up pressure against the frame as shown in FIG. 34, where spring roller ball indentation 3402 in frame 3400 allows for the positive lock-up. Referring again to FIG. 33, when lowering mainspring pressure to make the manual operation of the slide easier, it becomes easier for the slide to get bumped backwards, taking the gun out of battery. The indexing roller ball 3304 helps keep the slide 3306 in positive lock-up.

Figure 38:
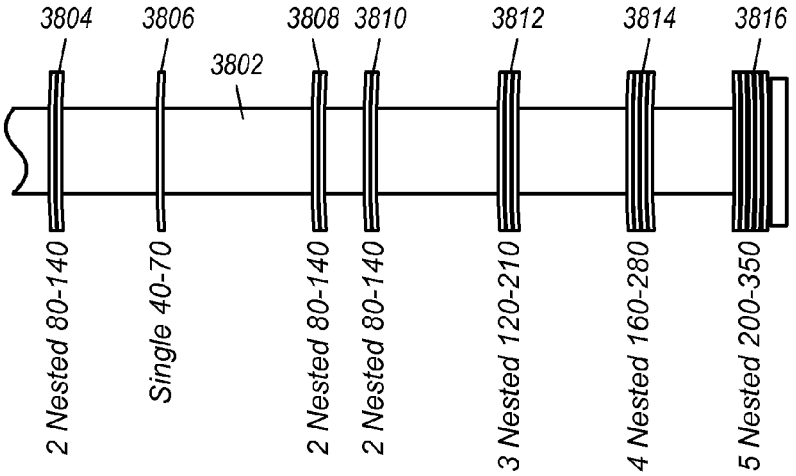
FIG. 38 is an illustration of a progressive Belleville spring stack on a guide rod, according to one embodiment.
Figure 39:
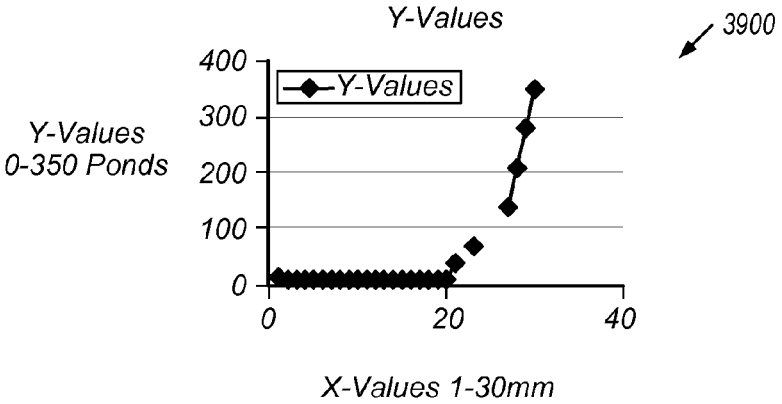
FIG. 39 is a graph illustrating the forces associated with the Belleville spring stack from FIG. 38.

As previously mentioned, a rebound spring stack may also facilitate keeping large loads in small spaces, and the conical springs are often used under bolt heads to maintain tension and keep the bolt from loosening. They're also used to maintain tension at the ends of valves and bearings. Referring again to FIG. 23, a Smith & Wesson guide rod 2206 for the M&P 9MM pistol may be improved using one embodiment of a rebound spring stack that includes Belleville spring stacks 2304, 2306, 2308, 2310, 2312, 2314, and 2316. The spring combination shown in FIG. 23 facilitates proper cycling of the 9MM, 9MM +P and 9MM Coffman Uber Magnum handgun. As shown in FIG. 23, the assembly includes a factory flat mainspring 2302, two nested Belleville springs opposed 2304, one Belleville spring opposed 2306, two nested Belleville springs opposed 2308, two nested Belleville springs opposed 2310, three nested Belleville springs opposed 2312, four nested Belleville springs opposed 2314, and five nested Belleville springs opposed 2316. Furthermore, FIG. 38 provides an illustration of an example combination of nested and opposed Belleville ring stacks 3804, 3806, 3808, 3810, 3812, 3814, and 3816 on a guide rod 3802, with a graph 3900 in FIG. 39 illustrating the forces associated with the Belleville spring stacks from FIG. 38.

Figure 37:
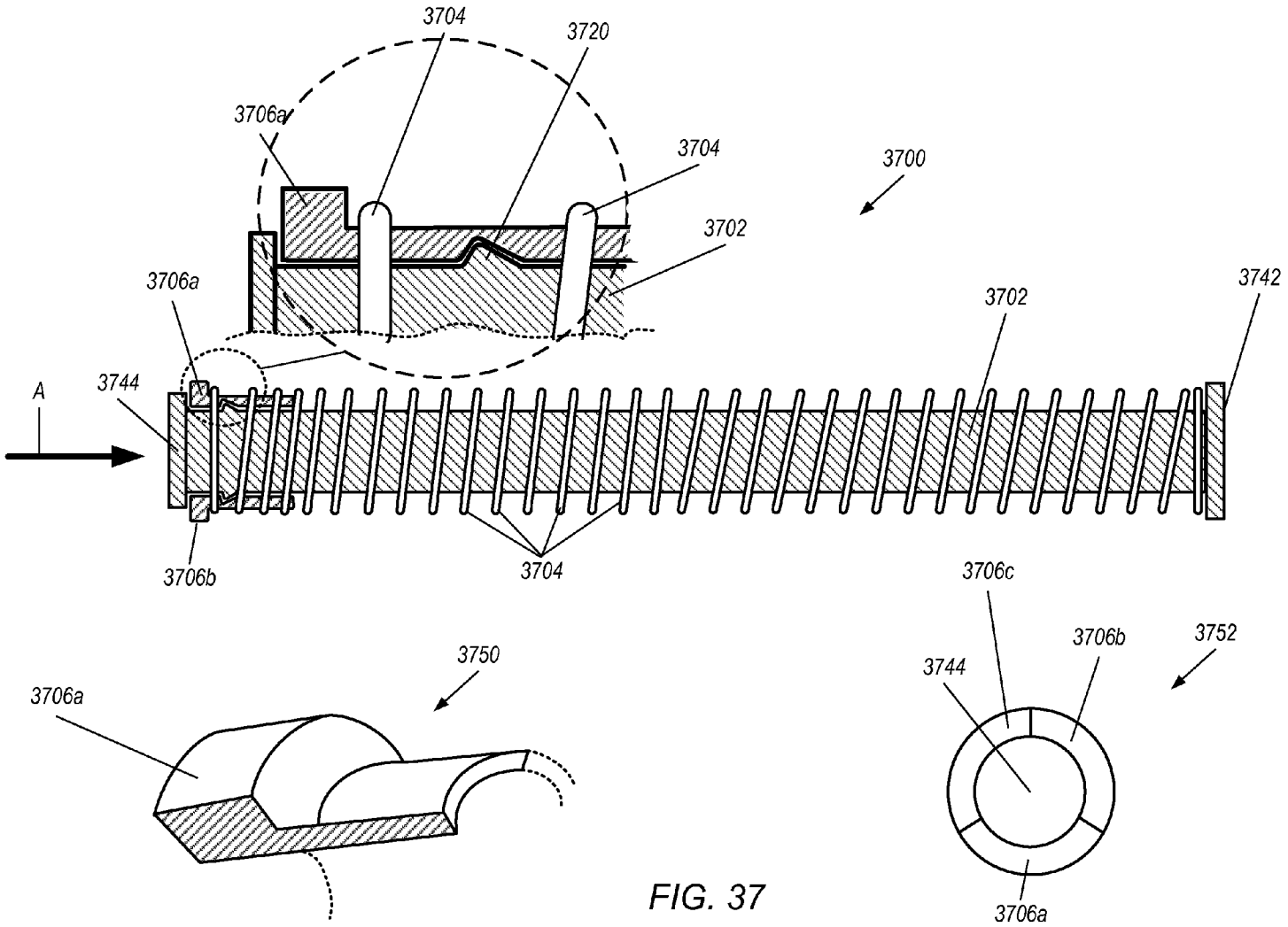
FIG. 37 is an illustration, from different angles, of a guide rod and coil spring assembly with a locking spring collet, according to one embodiment.

As a further improvement, spring collets may also be used to increase the lock-up force and/or delay the blowback of the slide. FIG. 37 is an illustration, from different angles, of various components of a gun assembly, including a guide rod and coil spring assembly with a locking spring collet, according to one embodiment. As shown in a cross sectional lengthwise view 3700, a guide rod 3702 with stops 3742 and 3744 at the two ends, respectively, may hold a captured coil spring 3704. In the embodiment shown, a spring collet constructed of three segments 3706*a*, 3706*b*, and 3706*c* may be retained by the coil spring 3704 as shown, right behind front stop 3744. The enlarged circled section illustrates a notch (or groove) and ridge 3720, whereby the ridge on guide rod 3702 catches in the respective notches (groove) of spring collets 3706*a*, 3706*b*, and 3706*c*, respectively. A top level view 3752 of the spring collet illustrates one embodiment in which the collet has been divided into three segments 3706*a*, 3706*b*, and 3706*c*, as they appear around guide rod 3702 when looking at the guide rod assembly in the direction of the arrow labeled 'A' (i.e. from the perspective seen by the arrow). In other embodiments, the collet may be divided into fewer or more segments as preferred. A tilted side view 3750 provides an illustration of the structure of any one of the collet segments 3706*a*, 3706*b*, and 3706*c*.

When the firearm is fired, the blowback of the slide may be delayed by the collet segments (or, collectively referred to as the collet), which may be retained by the main spring as they expand outwardly from the guide rod to travel over the lock-up ridge in the front of the guide rod. The ridge may be optimized to have a steeper angle that must be overcome during the initial blow back, but a more gradual ramp that makes returning to lock-up easier, as illustrated in cross sectional view 3700. The angles and radius of the ridge combined with the mechanical means of retaining the collets may facilitate an optimal tuning of the additional holding or lock-up force that can be maintained. It should be noted that while a coil spring may be adequate to hold the collets in place, the force of the main spring may also determine lock-up pressure. The heavier the mainspring, the more force is applied for lock-up. Various embodiments of a guide rod assembly may use a flat spring instead of a coil spring, in which case the collet may be designed differently in order to ensure proper capture of the collet.

Figure 40:
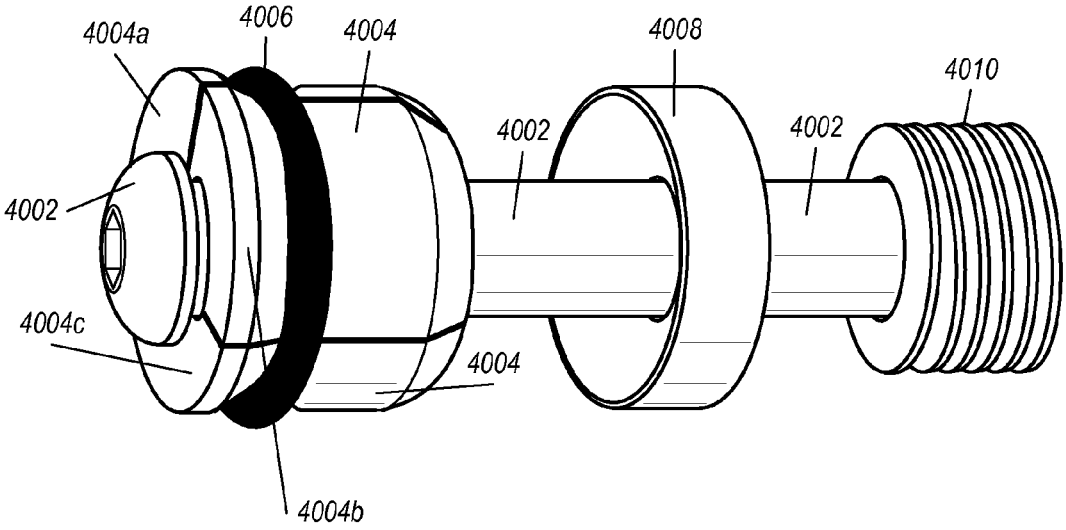
FIG. 40 is an illustration, from different angles, of a guide rod and flat spring assembly with a locking spring collet held in place by a retaining ring, according to one embodiment
Figure 40:
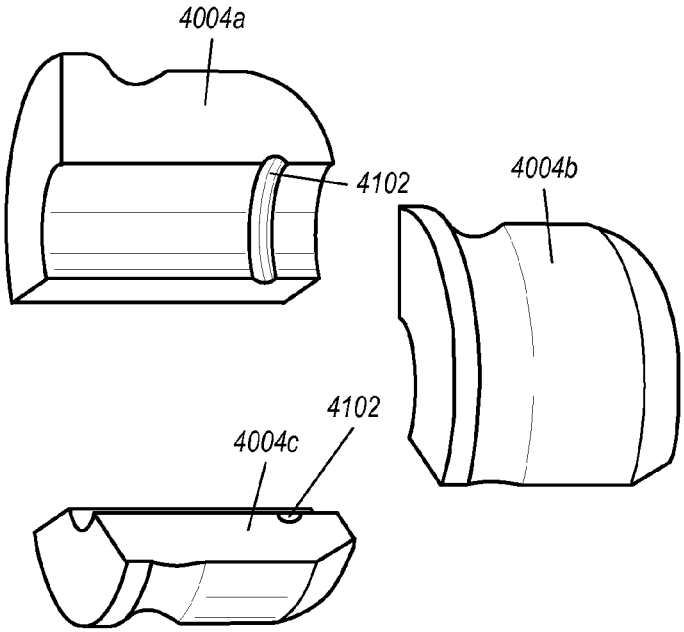

FIG. 40 provides an illustration of one embodiment of such a guide rod assembly with a guide rod (with capture) 4002 configured with a flat spring 4010. The embodiment in FIG. 40 shows a collet again implemented in three segments 4004*a*, 4004*b* and 4004*c*. As shown in FIG. 40, a retaining ring 4006 may retain the collet (segments), while a slide ring 4008 further supports the collet. The flat spring 4010 may apply the forward pressure to slide ring 4008, which provides inward pressure to collet 4004(*a, b*, and *c*). The collet may also be referred to as a lock-up collet. Retaining ring 4006 may be an O-ring, C-clip, or any other suitable device adaptable to hold the collet in place. Some of the components on the guide rod 4002 as illustrated in FIG. 40 are shown separate from each other to provide a better view. In addition, one embodiment of collet segments 4004*a*, 4004*b* and 4004*c* is shown beneath the guide rod assembly, illustrating the possible structure of one embodiment of the collet. A groove (notch) 4102 illustrated for segment 4004*a* is representative of the groove (notch) that may catch the ridge (or protrusion) from guide rod 4002, similar to the ridge/groove combination 3720 shown in FIG. 37.

Various embodiments of a novel spring recoil system include Belleville springs in nested and/or inverted stack configurations or combinations thereof adapted to the spring/rod recoil assembly of semiautomatic handguns. The novel spring recoil system improves the rebound, and reduces the impact, while facilitating adapting handguns to shoot bullets having differing power factors.

Although the embodiments above have been described in some detail, numerous variations and modifications will become apparent to those skilled in the art once the above disclosure is fully appreciated.

I claim:

1. A spring-based recoil assembly for a firearm, the assembly comprising:

a first spring that defines a first end a second end opposite the first end, the first spring cylindrically shaped;

a guide rod lengthwise situated within the first spring, the guide rod comprises a front-end and a back-end opposite the front-end, and the guide rod defines a back stop at the back-end;

a Belleville spring stack arranged on the guide rod, the Belleville spring stack defines first end and a second end opposite the first end, the first end abuts the first spring, and the second end abuts back stop.

a front stop proximate the front-end, the front stop on the guide rod, the first end of the first spring abuts the front stop on the guide rod;

a collet situated at the front-end of the guide rod behind a first stop at the front-end of the guide rod, the collet retained by one of:

the first spring when the first spring is a coil spring; or a retaining ring when the first spring is a flat spring;

wherein the collet is configured to perform one or more of:

increase a lock-up force of a slide of a firearm; or delay a blowback of the slide during firing of the firearm by expanding outwardly from the guide rod and traveling over a lock-up ridge situated towards the front-end of the guide rod.

2. The assembly of claim 1, wherein the lock-up ridge shows a steeper angle towards the front-end of the guide rod and a more gradual ramp toward a back-end of the guide rod.

3. The assembly of claim 1, wherein the collet is composed of two or more segments.

4. The assembly of claim 1, wherein the first spring is a flat spring, and wherein the assembly further comprises a slide ring captured between the collet and the first spring in support of the collet.

5. A spring-based recoil assembly for a firearm, the assembly comprising:

a first spring that defines a first end a second end opposite the first end, the first spring cylindrically shaped;

a guide rod lengthwise situated within the first spring, the guide rod comprises a front-end and a back-end opposite the front-end, and the guide rod defines a back stop at the back-end;

a Belleville spring stack arranged on the guide rod, the Belleville spring stack defines first end and a second end opposite the first end, the first end abuts the first spring, and the second end abuts back stop;

a front stop proximate the front-end, the front stop on the guide rod, the first end of the first spring abuts the front stop on the guide rod;

a tip at the front-end of the guide rod comprises an inner sleeve spanning underneath the first stop, wherein the inner sleeve comprises one of:

a bronze bearing impregnated with oil;

a bronze bearing impregnated with graphite; or a polymer.

6. A spring-based recoil assembly for a firearm, the assembly comprising:

a first spring that defines a first end a second end opposite the first end, the first spring cylindrically shaped;

a guide rod lengthwise situated within the first spring, the guide rod comprises a front-end and a back-end opposite the front-end, and the guide rod defines a back stop at the back-end;

a Belleville spring stack arranged on the guide rod, the Belleville spring stack defines first end and a second end opposite the first end, the first end abuts the first spring, and the second end abuts back stop;

a sleeve that defines an inside diameter, an outside diameter, a front-end, a back-end opposite the front-end, and a back stop at the back-end of the sleeve;

the sleeve telescoped over the guide rod and the sleeve telescoped over first spring;

a second spring that defines a first end and a second end opposite the first end, the second spring distinct from the first spring, and the second spring cylindrically shaped; and the second spring telescoped over the guide rod and telescoped over the sleeve, and the second end of the second spring abuts the back stop of the sleeve.

7. The spring-based recoil assembly of claim 6 further comprising:

a front stop proximate the front-end, the front stop on the guide rod; and the first end of the second spring abuts the front stop of the guide rod.

8. A firearm comprising:

a gun frame that defines a handle;

a barrel coupled to the gun frame;

a slide that houses a firing pin, the slide in operational relationship to the barrel and the gun frame;

a back chamber defined by the gun frame, the back chamber comprises a back wall; and a spring assembly coupled between the slide and the gun frame and configured to transfer recoil force from the slide to the gun frame, the spring assembly comprising:

a first spring that defines a first end and a second end opposite the first end, the first spring cylindrically shaped;

a guide rod lengthwise situated within the first spring, the guide rod comprises a front-end a back-end opposite the front end, and the guide rod defines a back stop at the back-end;

a Belleville spring stack arranged on the guide rod, the Belleville spring stack defines a first end and a second end opposite the first end, the first end abuts the first spring, and the second end abuts the back stop;

said spring assembly telescoped within the back chamber such that the first end of the Belleville spring stack resides within the back chamber and the back stop of the guide rod abuts the back wall of the back chamber.

9. The firearm of claim 8, further comprising:

wherein the spring assembly further comprises a collet situated at the front-end of the guide rod behind a first stop at the front end of the guide rod, the collet retained by one of:

the first spring when the first spring is a coil spring; or a retaining ring when the first spring is a flat spring;

wherein the collet is configured to perform one or more of:

increase a lock-up force of the slide; or delay a blowback of the slide during firing of the firearm by expanding outwardly from the guide rod and traveling over a lock-up ridge situated towards the front-end of the guide rod.

10. The firearm of claim 9, wherein the lock-up ridge shows a steeper angle towards the front-end of the guide rod and a more gradual ramp toward the back-end of the guide rod.

11. The firearm of claim 9, wherein the collet is composed of two or more segments.

12. The firearm of claim 9, wherein the first spring is a flat spring, and the spring assembly further comprises a slide ring configured between the collet and the first spring in support of the collet.

13. The firearm of claim 8, wherein the first spring is at least one selected from the group consisting of:

a coil spring; and a flat spring.

14. The firearm of claim 8, wherein a tip at the front-end of the guide rod comprises an inner sleeve spanning underneath a first stop, wherein the inner sleeve comprises one of:

a bronze bearing impregnated with oil;

a bronze bearing impregnated with graphite; or a polymer.

15. The firearm of claim 8 wherein the first spring is a flat spring.

16. The firearm of claim 15 further comprising:

said slide has a first orientation before firing the firearm in which the first spring is less than fully compressed and the first spring biases the slide to a forward position relative to the gun frame; and said slide has a second orientation after firing the firearm in which the flat spring is fully compressed.

17. The firearm of claim 8 further comprising:

a front stop proximate the front-end, the front stop on the guide rod; and the first end of the first spring abuts the front stop on the guide rod.

18. The firearm of claim 8 further comprising:

a sleeve that defines an inside diameter, an outside diameter, a front-end, a back-end opposite the front-end, and a back stop at the back-end of the sleeve;

the sleeve telescoped over the guide rod and the sleeve telescoped over first spring;

a second spring that defines a first end and a second end opposite the first end, the second spring distinct from the first spring, and the second spring cylindrically shaped; and the second spring telescoped over the guide rod and the sleeve, and the second end of the second spring abuts the back stop of the sleeve.

19. The firearm of claim 18 further comprising:

a front stop proximate the front-end, the front stop on the guide rod; and the first end of the second spring abuts the front stop of the guide rod.

20. The firearm of claim 18 further comprising:

said slide has a first orientation before firing the firearm in which the first spring biases the slide to a forward position relative to the gun frame, and the second spring biases the sleeve away from the Belleville spring stack such that the back stop of the sleeve is separated from the Belleville spring stack; and said slide has a second orientation after firing the firearm in which the sleeve abuts the Bellville spring stack.

21. A spring-based recoil assembly for a firearm, the assembly comprising:

a guide rod, the guide rod comprises a front-end and a back-end opposite the front-end, and the guide rod defines a back stop at the back-end;

a Belleville spring stack arranged on the guide rod, the Belleville spring stack defines first end and a second end opposite the first end, and the second end abuts the back stop of the guide rod;

a sleeve that defines an inside diameter, an outside diameter, a front-end, a back-end opposite the front-end, and a back stop at the back-end of the sleeve, the sleeve telescoped over the guide rod, and the first end of the Belleville spring stack abuts the back stop of the sleeve; and a spring that defines a first end a second end opposite the first end, the spring cylindrically shaped, and the spring telescoped over the guide rod.

22. The spring-based recoil assembly of claim 21 wherein the spring is a flat spring.

23. The spring-based recoil assembly of claim 21 wherein the spring telescopes over the sleeve and abuts the back stop of the sleeve.

24. The spring-based recoil assembly of claim 21 further comprising:

a front stop proximate the front-end, the front stop on the guide rod; and the first end of the first spring abuts the front stop on the guide rod.

25. A firearm comprising:

a gun frame that defines a handle;

a barrel coupled to the gun frame;

a slide that houses a firing pin, the slide in operational relationship to the barrel and the gun frame;

a back chamber defined by the gun frame, the back chamber comprises a back wall; and a spring assembly coupled between the slide and the gun frame and configured to transfer recoil force from the slide to the gun frame, the spring assembly comprising:

a guide rod, the guide rod comprises a front-end and a back-end opposite the front-end, and the guide rod defines a back stop at the back-end;

a Belleville spring stack arranged on the guide rod, the Belleville spring stack defines first end and a second end opposite the first end, and the second end abuts the back stop of the guide rod;

a sleeve that defines an inside diameter, an outside diameter, a front-end, a back-end opposite the front-end, and a back stop at the back-end of the sleeve, the sleeve telescoped over the guide rod, and the first end of the Belleville spring stack abuts the back stop of the sleeve; and a spring that defines a first end a second end opposite the first end, the spring cylindrically shaped, and the spring telescoped over the guide rod;

said spring assembly telescoped within the back chamber such that the first end of the Belleville spring stack resides within the back chamber and the back stop of the guide rod abuts the back wall of the back chamber.

26. The firearm of claim 25 wherein the spring is a flat spring.

27. The firearm of claim 26 further comprising:

said slide has a first orientation before firing the firearm in which the first spring is less than fully compressed, the first spring biases the slide to a forward position relative to the gun frame, and the sleeve is separated from the Belleville spring stack; and said slide has a second orientation after firing the firearm in which the flat spring is fully compressed and the sleeve abuts Belleville spring stack.

28. The firearm of claim 25 further comprising:

a front stop proximate the front-end, the front stop on the guide rod; and the first end of the first spring abuts the front stop on the guide rod.

29. The firearm of claim 25 further comprising:

said slide has a first orientation before firing the firearm in which the first spring is less than fully compressed, the first spring biases the slide to a forward position relative to the gun frame, and the sleeve is separated from the Belleville spring stack; and said slide has a second orientation after firing the firearm in which the sleeve abuts Belleville spring stack.

* * * * *